US011439175B2

(12) United States Patent
Kaufmann et al.

(10) Patent No.: US 11,439,175 B2
(45) **Date of Patent: *Sep. 13, 2022**

(54) COMPACTION APPARATUS AND RELATED METHODS

(71) Applicant: CANOPY GROWTH CORPORATION, Smiths Falls (CA)

(72) Inventors: Ben Kaufmann, Chelsea (CA); Rod Muir, South Mountain (CA); Mike Sirois, Ottawa (CA); Jessica Kara Smith, Perth (CA)

(73) Assignee: CANOPY GROWTH CORPORATION, Smiths Falls (CA)

( * ) Notice: Subject to any disclaimer, the term of this patent is extended or adjusted under 35 U.S.C. 154(b) by 502 days.

This patent is subject to a terminal disclaimer.

(21) Appl. No.: 16/661,105

(22) Filed: Oct. 23, 2019

(65) Prior Publication Data

US 2020/0054066 A1 Feb. 20, 2020

Related U.S. Application Data

(63) Continuation-in-part of application No. 16/391,468, filed on Apr. 23, 2019, now Pat. No. 11,259,559.

(60) Provisional application No. 62/810,017, filed on Feb. 25, 2019, provisional application No. 62/661,348, filed on Apr. 23, 2018.

(51) Int. Cl.

| | |
|---|---|
| ***A24C 5/06*** | (2006.01) |
| ***A24D 1/02*** | (2006.01) |
| *A24C 5/54* | (2006.01) |

(52) U.S. Cl.

CPC ..... *A24C 5/06* (2013.01); *A24D 1/02* (2013.01); *A24C 5/54* (2013.01)

(58) Field of Classification Search

CPC ..... A24C 5/02; A24C 5/06; A24C 5/42

See application file for complete search history.

(56) References Cited

U.S. PATENT DOCUMENTS

| | | | |
|---|---|---|---|
| 9,814,259 | B1 | 11/2017 | Richmond |
| 2008/0264432 | A1 | 10/2008 | Moser |
| 2016/0120212 | A1 | 5/2016 | Heidtmann |
| 2017/0119043 | A1 | 5/2017 | Swanson |

FOREIGN PATENT DOCUMENTS

| | | | |
|---|---|---|---|
| WO | 02056714 | A1 | 7/2002 |
| WO | 2017/172844 | A1 | 5/2017 |

OTHER PUBLICATIONS

International Search Report and Written Opinion issued in PCT/CA2019/050500, dated Jun. 20, 2019, 7 pages.

*Primary Examiner* — Eric Yaary

(74) *Attorney, Agent, or Firm* — Stinson LLP

(57) ABSTRACT

A method of compacting a smokeable product in a cone for production of smoking articles is disclosed. The method includes aligning a respective cone held in a cone pallet with a pin. The cone contains a volume of the smokeable product and has an open upper end. The method further includes advancing the pin into the volume of the smokeable product through the open upper end of the cone; and withdrawing the pin from the volume of the smokeable product. The volume of the smokeable product has an empty column formed therein when the pin is withdrawn. The method further includes vibrating the cone pallet to induce collapse of the smokeable product into the column.

28 Claims, 24 Drawing Sheets

COMPACTION APPARATUS AND RELATED METHODS

CROSS-REFERENCE TO RELATED APPLICATIONS

This application is a continuation-in-part of and claims priority to U.S. patent application Ser. No. 16/391,468, filed on Apr. 23, 2019, which is based on and claims priority to U.S. Provisional Application Ser. No. 62/661,348, filed on Apr. 23, 2018, and U.S. Provisional Application Ser. No. 62/810,017, filed on Feb. 25, 2019, each of which is incorporated herein by reference in its entirety.

FIELD

The specification relates generally to mass production of smoking articles, and more specifically, to apparatuses and methods for compacting a smokeable product in mass production of conical smoking articles.

BACKGROUND

Int. Pub. No. WO 2017/172844 A1 discloses an apparatus including a holder plate and a carriage assembly. The holder plate includes a plurality of through-holes configured to receive containers having an interior cavity. The carriage assembly comprises one or more carriage plates and tamper rods, the carriage plates having a plurality of through-holes. Each of the tamper rods can be slidably disposed in a respective one of the plurality of through-holes of the carriage plate. Each of the tamper rods can be independently weighted to provide a force independent of the other of the tamper rods and can be independently movable relative to the other of the tamper rods. The carriage assembly can be configured to be aligned with the holder plate such that the each of the tamper rods provides a compressive force to a filler material within the interior cavity of each of the containers.

U.S. Pat. App. Pub. No. 2016/0120212 A1 discloses a tube filling apparatus. The apparatus includes a base and a filling assembly mountable on the base. The filling assembly has a number of tube receiving recesses wherein tubes may, in use, be received. The apparatus further includes a vibration plate which is locatable between the base and the filling assembly. In use, the tubes rest on the vibration plate when they are located in the recesses. The apparatus also includes vibrating means which is connected to the vibration plate for, in use, vibrating the vibration plate, which is capable of moving independently from the filling assembly.

SUMMARY

The following summary is intended to introduce the reader to various aspects of the applicant's teaching, but not to define any invention.

According to some aspects, a method of compacting a smokeable product in a cone for production of smoking articles includes: (a) aligning a respective cone held in a cone pallet with a pin, the cone containing a volume of the smokeable product and having an open upper end; (b) advancing the pin into the volume of the smokeable product through the open upper end of the cone; (c) withdrawing the pin from the volume of the smokeable product, the volume of the smokeable product having an empty column formed therein when the pin is withdrawn; and (d) vibrating the cone pallet to induce collapse of the smokeable product into the column.

In some examples, the pin is completely withdrawn from the volume of the smokeable product prior to performing (d). In some examples, (d) includes vibrating the cone pallet horizontally.

In some examples, the method further includes: (e) repeating (b) to (d) to perform a plurality of successive compaction cycles. In some examples, (b) includes inserting the pin into the cone to an insertion depth. In some examples, the insertion depth varies between two or more of the compaction cycles. In some examples, the insertion depth is less for a subsequent compaction cycle relative to an immediately preceding compaction cycle.

In some examples, the method further includes, when the pin is in the volume of the smokeable product, vibrating the pin to induce settlement of the smokeable product in the cone.

In some examples, the method further includes urging a tamping face downwardly against an upper surface of the smokeable product to exert a compressive force thereon. In some examples, the tamping face is urged downwardly after (d). In some examples, the method further includes vibrating the tamping face at least when the tamping face is urged downwardly.

According to some aspects, a compaction apparatus for compacting a smokeable product in production of smoking articles includes: (a) a frame for removably receiving a cone pallet, the cone pallet including a plurality of cavities, each cavity holding a respective cone filled with a volume of the smokeable product, each cone having an open upper end; and (b) a compaction mechanism supported by the frame. The compaction mechanism includes: (i) at least one pin extending along a pin axis and alignable above the open upper end of a respective cone. When aligned, the pin is movable relative to the cone pallet from a pin retracted position, in which the pin is spaced apart from the smokeable product in the cone, toward a pin advanced position in which a lower portion of the pin is inserted into the volume of the smokeable product in the respective cone. The pin forms an empty column in the volume of the smokeable product when withdrawn. The compaction mechanism further includes (ii) a pallet vibratory drive coupled to the cone pallet when the pallet is received in the frame for vibrating the cone pallet to induce collapse of the smokeable product into the column.

In some examples, the pallet vibratory drive is operable to impart horizontal vibrations to the cone pallet when the cone pallet is received in the frame.

In some examples, a platform is supported by the frame for supporting the cone pallet when the cone pallet is received in the frame. The pallet vibratory drive is coupled to the platform for imparting vibrations thereto to vibrate the cone pallet.

In some examples, the compaction mechanism includes a pin vibratory drive coupled to the pin. The pin vibratory drive is operable to vibrate the pin at least when the pin is in the pin advanced position to induce settlement of the smokeable product in the respective cone.

According to some aspects, a compaction apparatus for compacting a smokeable product in production of smoking articles includes: (a) a frame for removably receiving a cone pallet, the cone pallet including a plurality of cavities, each cavity holding a respective cone filled with a volume of the smokeable product, each cone having an open upper end; and (b) a compaction mechanism supported by the frame.

The compaction mechanism includes: (i) at least one pin extending along a pin axis and alignable above the open upper end of a respective cone, and when aligned, the pin is movable relative to the cone pallet from a pin retracted position, in which the pin is spaced apart from the smokeable product in the cone, toward a pin advanced position in which a lower portion of the pin is inserted into the volume of the smokeable product in the respective cone; and (ii) at least one tamping rod separate from the pin and having a tamping face alignable above the open upper end of the respective cone, and when aligned, the tamping face is moveable relative to the cone pallet from a tamping retracted position in which the tamping face is spaced apart from the smokeable product in the cone, toward a tamping advanced position in which the tamping face is urged downwardly against an upper surface of the volume of smokeable product to exert a compressive force thereon.

In some examples, the compaction mechanism includes a carriage movably supported by the frame, and one of the at least one pin and the at least one tamping rod is mounted to the carriage.

In some examples, the carriage is movable between a carriage retracted position and a carriage advanced position. When the carriage is in the carriage retracted position, the one of the at least one pin and the at least one tamping rod is horizontally clear of the cone pallet when the cone pallet is received in the frame, and when the carriage is in the carriage advanced position, the one of the at least one pin and the at least one tamping rod is alignable with the respective cavity of the cone pallet when the cone pallet is received in the frame.

In some examples, the other one of the at least one pin and the at least one tamping rod is generally fixed relative to the frame and is above the cone pallet when the cone pallet is received in the frame.

In some examples, when the carriage is in the carriage advanced position, the one of the at least one pin and the at least one tamping rod is below and in alignment with the other one of the at least one pin and the at least one tamping rod.

In some examples, the compaction mechanism includes at least one horizontal carriage rail supported by the frame, and wherein the carriage is slidably mounted on the rail for translation along the rail between the carriage retracted position and the carriage advanced position. In some examples, the rail is at an elevation above the one of the at least one pin and the at least one tamping rod when the carriage is in the carriage advanced position. In some examples, the rail is at an elevation above a tip of the at least one pin when the at least one pin is in the pin advanced position, and above the tamping face when the tamping face is in the tamping advanced position.

In some examples, a pallet actuator is supported by the frame and includes a vertically translatable platform for supporting the cone pallet when the cone pallet is received in the frame. The platform is vertically translatable relative to the frame for translating the cone pallet among a lowered position, a first raised position above the lowered position, and a second raised position above the first raised position. The lowered position corresponds to the pin retracted position and the tamping retracted position, the first raised position corresponds to one of the pin advanced position and the tamping advanced position, and the second raised position corresponds to the other one of the pin advanced position and the tamping advanced position. In some examples, the rail is at an elevation above the cone pallet when the cone pallet is in the second raised position.

In some examples, the compaction mechanism comprises a pin vibratory drive coupled to the pin for vibrating the pin at least when the pin is in the pin advanced position. In some examples, the compaction mechanism includes at least one tamping vibratory drive coupled to the tamping rod for vibrating the tamping face at least when the tamping face is in the tamping advanced position. In some examples, the compaction mechanism includes a pallet vibratory drive coupled to the cone pallet when the cone pallet is received in the frame for vibrating the cone pallet. In some examples, the pin tip has a pin tip diameter, and the tamping face has a tamping face diameter greater than the pin tip diameter.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
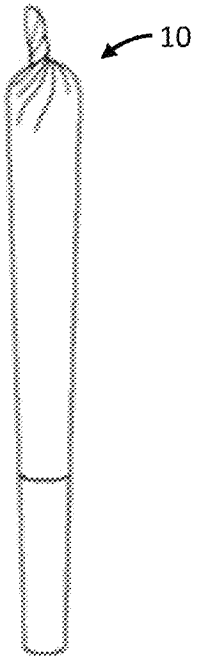
FIG. 1 is a perspective view of an example conical smoking article.

Smoking articles having a conical shape, like that of the example smoking article 10 shown in FIG. 1, are popular among a variety of users, including, for example, *cannabis* users. Smoking articles having a conical shape are typically hand-made, or otherwise produced in small, labor-intensive batches. In contrast, cylindrical smoking articles, such as traditional tobacco cigarettes, are often manufactured in high volume production systems with a high degree of sophisticated automation. But the difference in shape, among other reasons, can render the processes and apparatus of such automated systems inapplicable to conically shaped smoking articles such as the article 10.

Figure 2A:
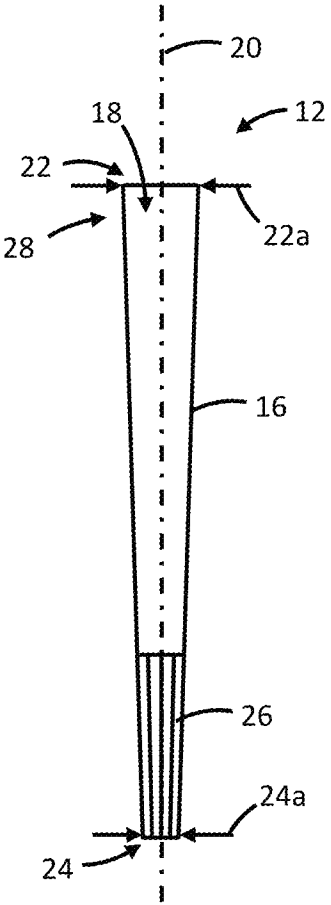
FIG. 2A is a cross-sectional view of the cone of FIG. 2, taken along line 2A-2A of FIG. 2.
Figure 2:
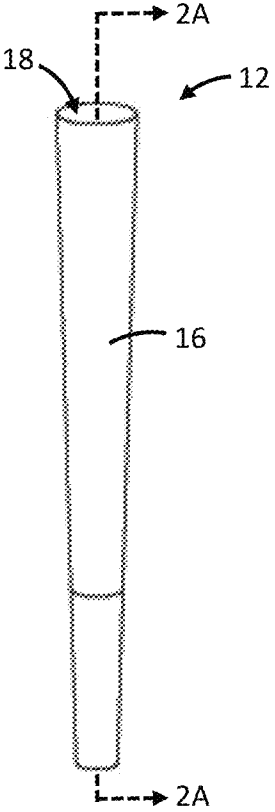
FIG. 2 is a perspective view of an example cone for manufacture of the smoking article of FIG. 1.

Referring to FIGS. 1 and 2, in the example illustrated, the example smoking article 10 is formed using a cone 12. The cone 12 is formed of a smokeable wrapper 16 having a cone cavity 18 for receiving and containing a smokeable product. In the example illustrated, the wrapper 16 is generally air impermeable, and the smokeable product is a granular product. In some examples, the cone 12 can be preassembled and the cone cavity 18 can be subsequently filled with the smokeable product. The smokeable product can be prepared via chopping, grinding, and/or sifting of a bulk smoking material. The bulk smoking material can include, for example, dried *cannabis* plant material, and the smokeable product can include *cannabis* granules.

Referring to FIG. 2A, in the example illustrated, the cone cavity 18 extends along a cone cavity axis 20 between an upper end 22 and a lower end 24 opposite the upper end 22. In the example illustrated, the wrapper 16 has an upper end diameter 22*a* at the upper end 22 of the cavity 18 and a lower end diameter 24*a* at the lower end 24 of the cavity 18. The lower end diameter 24*a* is smaller than the upper end diameter 22*a*, and the wrapper 16 tapers radially inwardly along the cavity axis 20 from the upper end diameter 22*a* to the lower end diameter 24*a* to provide the cone 12 with a generally conical shape. In the example illustrated in FIG. 2A, the upper end 22 of the cavity 18 is open for permitting filling of the cavity 18 with the smokeable product. In the example illustrated, the cone 12 includes a filter 26 in the cavity 18 adjacent the lower end 24. The filter 26 can help to provide structural stability to the smoking article 10, and can help inhibit smokeable product in the cavity 18 from escaping through the lower end 24.

Figure 3:
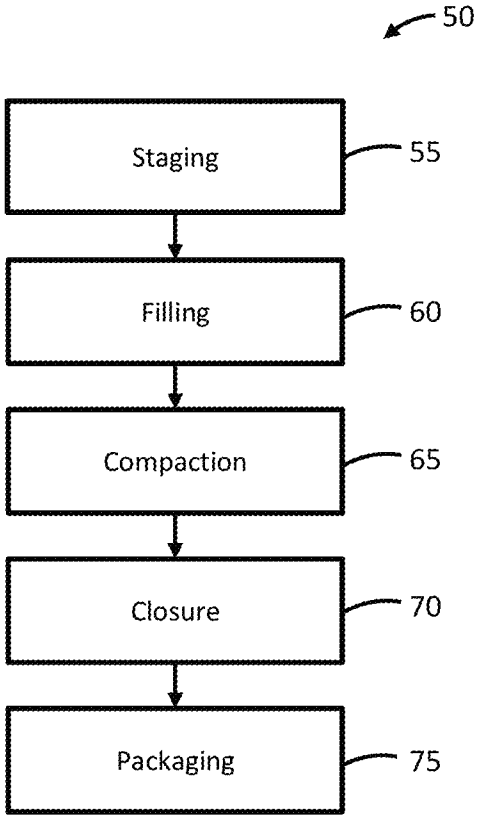
FIG. 3 is a flow chart showing an example process for mass production of conical smoking articles like that of FIG. 1.

Referring to FIG. 3, an example process 50 for mass production of conical smoking articles is shown, and will be described with respect to the example smoking article 10.

Figure 4:
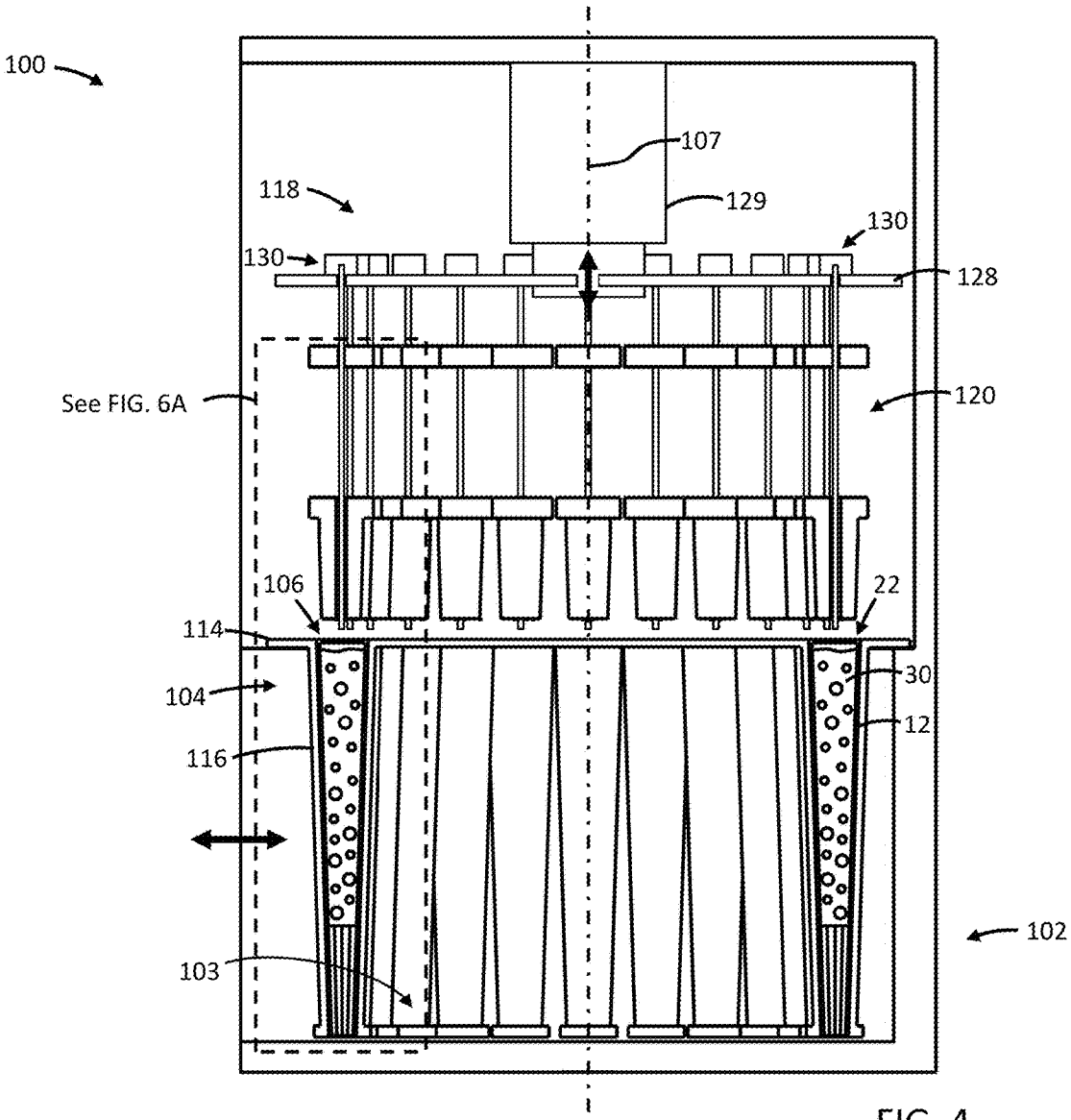
FIG. 4 is a schematic cross-sectional elevation view of an example compaction apparatus, showing a compaction mechanism of the apparatus in a retracted state.

At step 55 of the process 50, a plurality of the cones 12 are staged for filling with a smokeable product 30 (FIG. 4). The cones 12 can be staged by, for example, being positioned in a pallet with the open upper ends 22 directed upwardly for receiving the smokeable product.

At step 60, the staged cones 12 can be filled with the smokeable product 30 through respective open upper ends 22 of each cone 12. The cones 12 can be filled while held in the pallet.

At step 65, the smokeable product 30 in the cones 12 is compacted. The smokeable product 30 in the cones 12 can be compacted using compaction apparatuses and methods like those described in more detail below with respect to FIGS. 4 to 33. The smokeable product 30 can be compacted from, for example, a first height 32 (FIG. 6A) above the lower end 24 of the cone 12 to a second height 34 (FIG. 6C) above the lower end 24 of the cone 12 that is less than the first height 32. The smokeable product 30 can be compacted while the cones 12 are held in the pallet.

At step 70, an upper portion 28 of each wrapper 16 is twisted to close the upper end 22 of the cavity 18 for inhibiting the granule product from escaping from the cavity 18, and to form the smoking article 10. At step 75, the smoking articles 10 can be packaged for shipment and/or sale.

Referring to FIG. 4, an example compaction apparatus 100 for use during the compaction step 65 is shown, and will be described with respect to the example cone 12 of FIG. 2. In the example illustrated, the compaction apparatus 100 includes a frame 102 defining at least one station 103 for removably receiving a cone pallet 104.

In the example illustrated, the cone pallet 104 includes a plurality of pallet cavities 106. Each pallet cavity 106 holds a respective cone 12 filled with a volume of the smokeable product 30, and with the open upper end 22 of the cones 12 directed upwardly.

Figure 5:
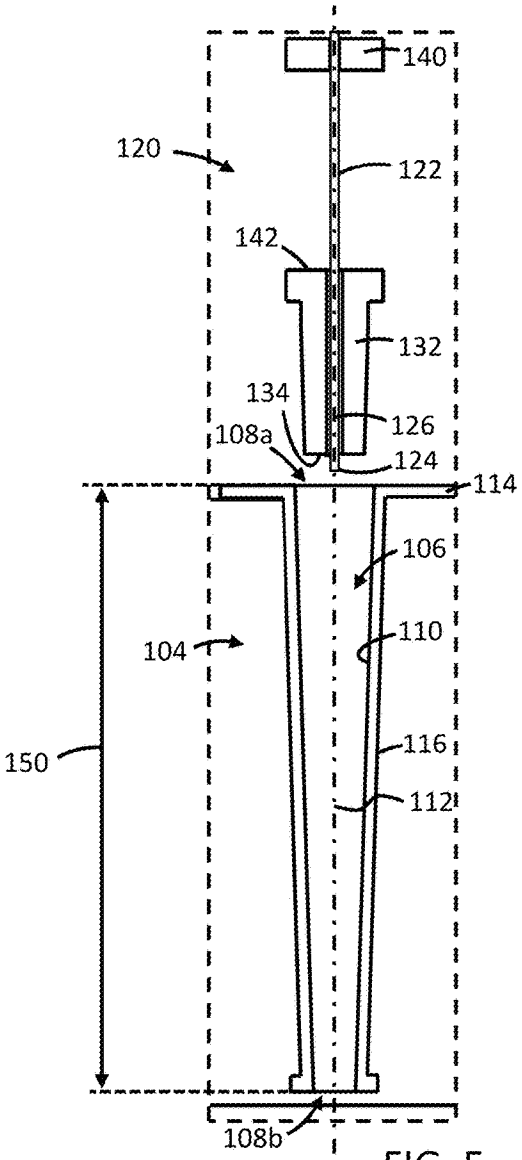
FIG. 5 is an enlarged view of a portion of FIG. 4, but with background structure and a cone removed.

Referring to FIG. 5, each pallet cavity 106 is defined by an inner surface 110 extending along a pallet cavity axis 112 between an open upper end 108*a* for receiving a cone 12 and a lower end 108*b* opposite the upper end 108*a*. In the example illustrated, the inner surface 110 tapers radially inwardly along the axis 112 from the upper end 108*a* toward the lower end 108*b* to provide the inner surface 110 with a generally conical shape corresponding to that of at least a portion of the cone 12. In the example illustrated, the pallet 104 has a pallet body 114, and the pallet cavities 106 are provided in respective nests 116 attached to the pallet body 114.

Referring to FIG. 4, in the example illustrated, the apparatus 100 further includes a compaction mechanism 118 positionable above the cone pallet 104 when the cone pallet 104 is received in the station 103. In the example illustrated, the compaction mechanism 118 is supported by the frame 102. The compaction mechanism 118 includes at least one pin assembly 120 for inducing compaction of smokeable product 30 held in a respective cone 12. In the example illustrated, the compaction mechanism 118 includes a plurality of the pin assemblies 120, with each pin assembly 120 aligned above the open upper end 22 of a respective cone 12. In the example illustrated, the quantity of pin assemblies 120 is equal to the quantity of pallet cavities 106 (and cones 12). In the example illustrated, the compaction mechanism 118 includes twenty-four (24) pin assemblies 120 and the pallet includes twenty-four (24) pallet cavities 106. In some examples, the compaction mechanism 118 can include a different quantity of pin assemblies 120 such as, for example, fifty-four (54) pin assemblies 120, and the pallet 104 can include fifty-four (54) pallet cavities 106 (and cones 12). In the example illustrated, each of the plurality of pin assemblies 120 and the plurality of pallet cavities 106 are arranged in a circular array about a vertical axis 107.

Figure 6A:
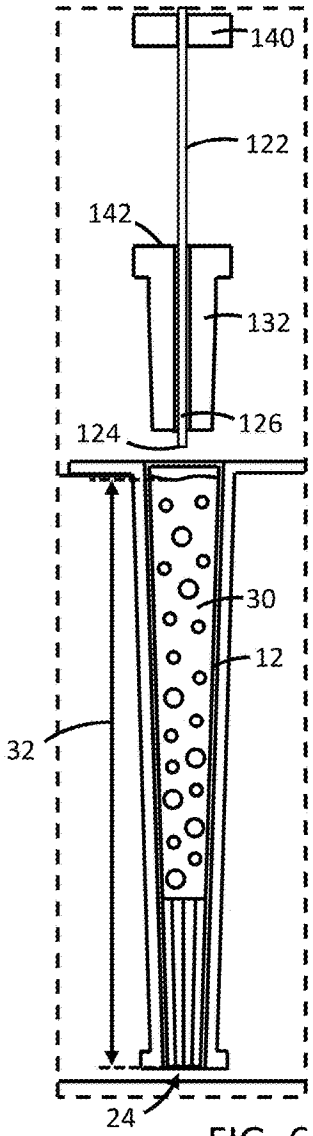
FIG. 6A is an enlarged view like that of FIG. 5, but showing the cone held in a pallet cavity of the apparatus of FIG. 4.
Figure 6C:
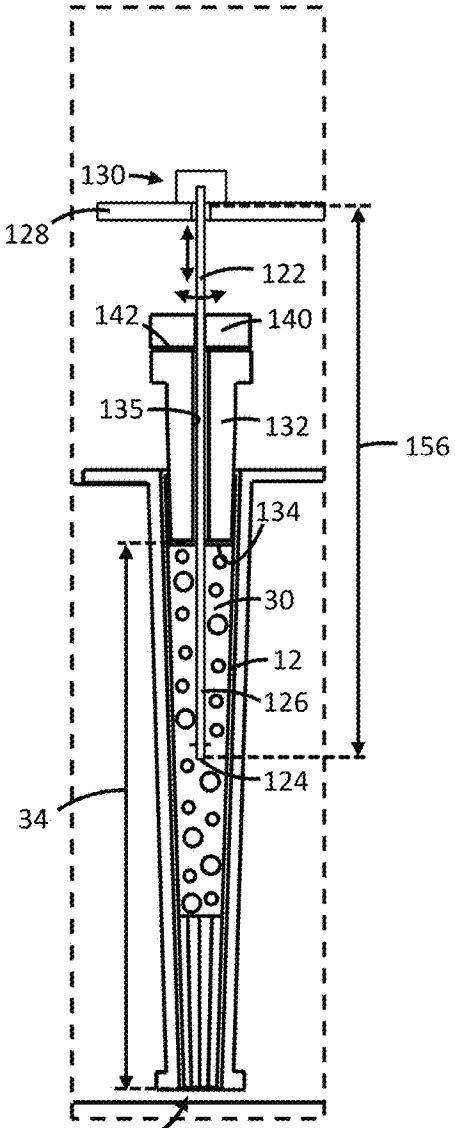
FIG. 6C is an enlarged view like that of FIG. 6B, but showing a portion of the compaction mechanism in an advanced state.

Referring to FIG. 5, in the example illustrated, each pin assembly 120 includes a pin 122 extending along a pin axis and alignable with the open upper end 22 of a respective cone 12 (and with the open upper end 108*a* of a respective cavity 106). The pin axis is oriented vertically and generally coaxial with the pallet cavity axis 112 in the example of FIG. 5. When aligned, the pin 122 is movable vertically relative to the cone pallet 104 from a pin retracted position distal the cone pallet 104 (shown in FIGS. 5 and 6A) toward a pin advanced position proximate the cone pallet 104 (shown in FIG. 6C). Referring to FIG. 6A, when the pin 122 is in the pin retracted position, the pin 122 is spaced apart from the smokeable product 30 in a cone 12 held in a respective cavity 106. In the example illustrated, when the pin 122 is in the pin retracted position, a pin tip 124 of the pin 122 is spaced above the smokeable product 30 and the pallet 104. Referring to FIG. 6C, the pin 122 is movable toward the pin advanced position for inserting a lower portion 126 of the pin 122 into a volume of the smokeable product 30 in the cone 12 held in the pallet cavity 106.

Referring to FIG. 4, in the example illustrated, the pin assemblies 120 are supported by and extend downwardly from a pin carrier 128. In the example illustrated, the pin carrier 128 is coupled to the frame 102 via a linear actuator 129 operable to vertically translate the pin carrier 128 along the axis 107 to move the pins 122 between the pin retracted and advanced positions. In some examples, the pin carrier 128 can be fixed relative to the frame 102, and the cone pallet 104 can be raised relative to the frame 102 toward the pin carrier 128 to advance the pins 122 toward the advanced position. In some examples, both the pin carrier and the pallet 104 can be movable relative to the frame 102 and translated toward one another to advance the pins 122 toward the advanced position.

In the example illustrated, the compaction mechanism 118 includes one or more vibratory drives 130 coupled to the pins 122. In the example illustrated, each pin 122 is shown coupled to a respective vibratory drive 130. In some examples, one vibratory drive 130 may be provided for vibrating a plurality of the pins 122.

Referring to FIG. 6C, the vibratory drive 130 is operable to vibrate a respective pin 122. In the example illustrated, the drive 130 is operable to vibrate the pin 122 at least when the pin 122 is in the advanced position (i.e. when the lower portion 126 of the pin 122 is within the volume of the smokeable product 30 of a respective cone 12) for inducing settlement of the smokeable product 30. The vibratory drive 130 can be operable to oscillate the pin 122 to drive vibration thereof. For example, the vibratory drive can be operable to oscillate the pin 122 about and/or along a vertical axis (e.g. the pin axis and/or the pallet cavity axis 112) to vibrate the pin 122, and/or the vibratory drive 130 can be operable to oscillate the pin 122 about and/or along a horizontal axis. In the example illustrated, the vibratory drive 130 is tunable to adjust at least one of a vibration frequency and a vibration amplitude for vibrating the pin 122.

Figure 6B:
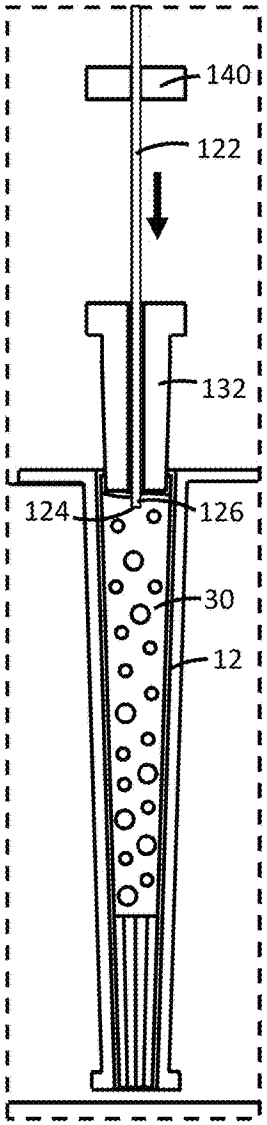
FIG. 6B is an enlarged view like that of FIG. 6A, but showing a portion of the compaction mechanism in an intermediate state.

Referring to FIGS. 6B and 6C, in the example illustrated, each pin assembly 120 includes a collar 132 positionable in the open upper end 22 (FIG. 2A) of a respective cone 12 atop the smokeable product 30 for generally covering the open upper end 22 when the pin 122 is in the pin advanced position. Referring to FIG. 6C, in the example illustrated, the collar 132 includes a front face 134 for bearing against an upper surface of the smokeable product 30 in the respective cone 12, and an interior aperture 135 for slidably receiving the pin 122 therethrough. Referring to FIGS. 6B and 6C, when the collar 132 is positioned atop the smokeable product 30, the pin 122 is translatable relative to the collar 132 during movement toward the pin advanced position. In the example illustrated, the collar 132 can exert a compressive force against the smokeable product 30. In the example illustrated, the collar 132 can be urged downwardly to exert the compressive force.

Figure 7A:
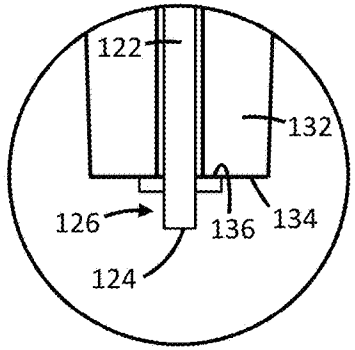
FIG. 7A is an enlarged view of a lower portion of a pin assembly of the apparatus of FIG. 4, showing a portion of a collar of the pin assembly in engagement with a catch of the pin assembly.
Figure 7B:
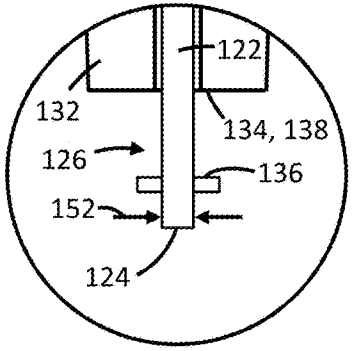
FIG. 7B is an enlarged view like that of FIG. 7A, but showing the collar spaced vertically apart from the catch.

Referring to FIGS. 7A and 7B, in some examples, the pin assembly 120 can include a catch 136 attached to the lower portion 126 of the pin 122 for engagement with an engagement surface 138 (FIG. 7B) of the collar 132 above the catch 136 for limiting downward movement of the collar 132. In the example illustrated, when the pin 122 is in the pin retracted position, the catch 136 is above the smokeable product 30 (and the pallet cavity 106) and is engagement with the engagement surface 138 of the collar 132 to inhibit the collar 132 from sliding off the pin 122. When the pin 122 is in the pin advanced position, the catch 136 is positioned in the smokeable product 30, and the engagement surface 138 of the collar 132 is above the smokeable product 30 and spaced vertically apart from (above) the catch 136.

The catch 136 can comprise, for example, a projection extending radially outwardly from an outer surface of the pin 122, and can be sized to reduce interference with advancement and retraction of the pin 122 into and out from the smokeable product 30, while still ensuring sufficient engagement with the collar 132 for raising the collar 132 when the pin 122 moves to the pin retracted position. In the example illustrated, the engagement surface 138 comprises the front face 134 of the collar 132. In some examples, the catch 136 may be omitted. For example, the collar 132 may be moved via an actuator relative to the pin, may be engageable with a catch fixed relative to the pin carrier 128, and/or manually positioned atop the smokeable product 30 and the pin 122 may be subsequently advanced through the collar 132 and into the smokeable product 30.

Referring to FIG. 6A, in the example illustrated, each pin assembly 120 includes a plunger 140 attached to the pin 122 above a rear face 142 of the collar 132 that is opposite the front face 134. In the example illustrated, the plunger 140 is spaced apart from the rear face 142 of the collar 132 when the pin 122 is in the pin retracted position. Referring to FIG. 6C, the plunger 140 can bear against the rear face 142 of the collar 132 when the pin 122 is in the pin advanced position for pushing the collar 132 downwardly to exert the compressive force. In the example illustrated, the collar 132 is formed of a generally rigid material (e.g. metal or plastic), and the plunger 140 is formed of a generally elastic material (e.g. rubber). In some examples, the plunger can be formed from an easily cleanable and hard material, such as stainless steel or aluminum.

Referring to FIG. 5, in the example illustrated, each pallet cavity 106 has a cavity height 150 between the upper end 108*a* and the lower end 108*b* of the pallet cavity 106. Referring to FIG. 6C, in the example illustrated, the pin 122 advances through at least 20% of the cavity height 150 when moving toward the pin advanced position. In some examples, the pin may be advanced through at least 50% of the cavity height 150 when moving toward the pin advanced position.

Referring to FIG. 7B, in the example illustrated, the pin has a pin outer diameter 152, and in some examples, the pin outer diameter 152 can be, for example, greater than 1.1 mm. In some examples, the pin outer diameter 152 can be greater than 1.3 mm. Referring to FIG. 6C, in the example illustrated, the pin 122 has a pin length 154 between the pin tip 124 and an anchor end opposite the pin tip 124, and in some examples, the pin length 154 can be, for example, at least 100 mm. In some examples, the pin length can be about 122 mm and the outer diameter can be about 1.35 mm. The pin outer diameter 152 and/or the pin length 154 may be selected based on, for example, the dimensions of the cones 12 and/or the pallet cavities 106 and/or the compacting characteristic of the selected smokeable material used to fill the cones.

Figure 8:
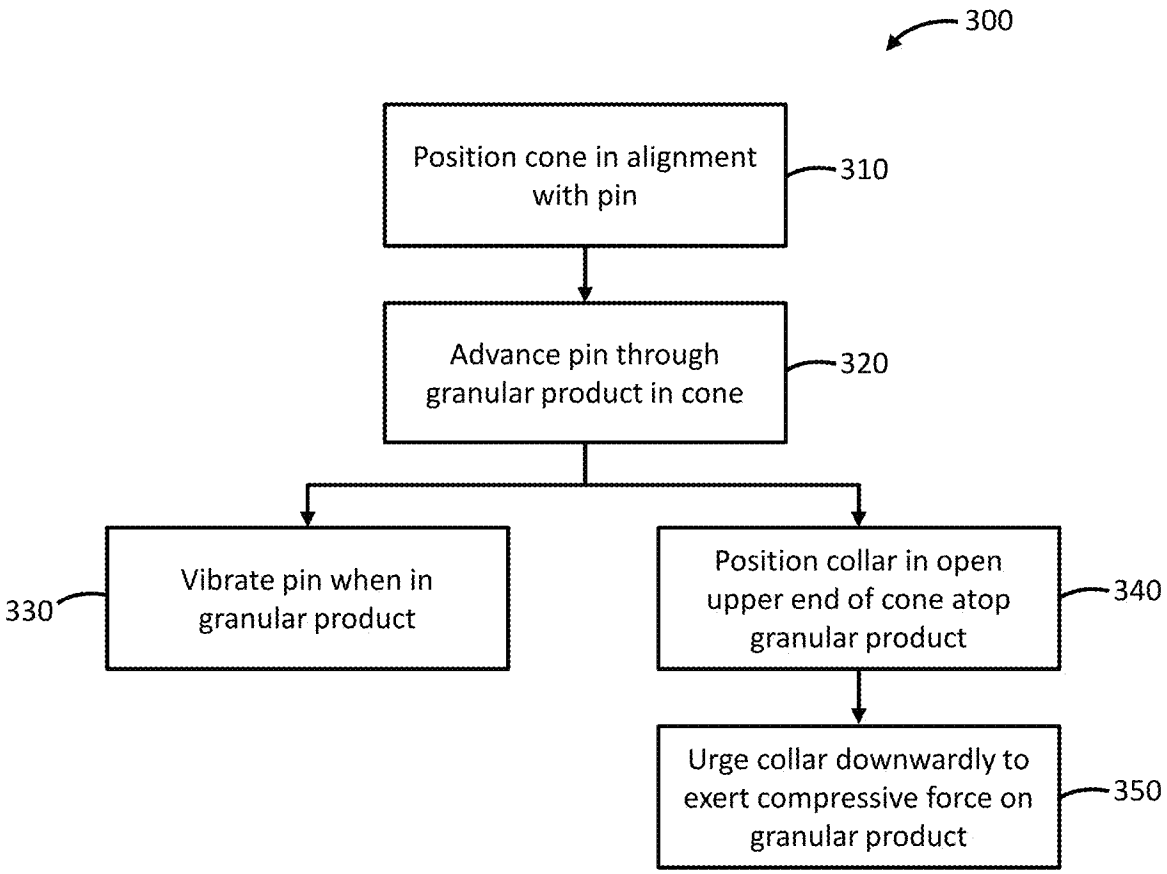
FIG. 8 is a flow chart showing an example process for mass production of conical smoking articles using an apparatus like that of FIG. 4.

Referring to FIG. 8, an example process 300 for mass production of smoking articles using a compaction apparatus similar to the compaction apparatuses of the present specification is shown, and will be described with respect to compaction apparatus 100. At step 310 of the process 300, a respective cone 12 received in the cone pallet 104 and holding a volume of the smokeable product 30 is positioned in alignment with a respective pin 122. At step 320, the pin 122 is advanced into the volume of the smokeable product 30 through the open upper end 22 of the cone 12. At step 330, when the pin 122 is in the volume of the smokeable product 30, the pin is vibrated to induce settlement of the smokeable product 30. The pin 122 can be vibrated while being advanced through the smokeable product 30, while being withdrawn from the smokeable product 30, and/or while in a pin advanced position in the smokeable product 30. In some examples, the pin 122 can be vibrated for at least 8 seconds when in the smokeable product 30.

At step 340, the collar 132 is positioned in the open upper end 22 of the cone 12 atop the smokeable product 30, and at step 350, the collar 132 is urged downwardly to exert a compressive force on the smokeable product 30. The collar can be urged downwardly via the plunger 340. In some examples, the collar 132 can exert the compressive force via gravitational force. In some examples, the compressive force is exerted for at least 8 seconds.

During the process 300, steps 330 and 350 can be performed simultaneously.

Step 320 can further include advancing the pin 122 through the collar 132 while the collar 132 is atop the smokeable product 30. In some examples, the process 300 can further include withdrawing the pin 122 from the smokeable product 30 while the collar 132 is atop the smokeable product 30.

The process 300 can further include tuning at least one of a vibration frequency and a vibration amplitude for vibrating the pin.

Figure 22B:
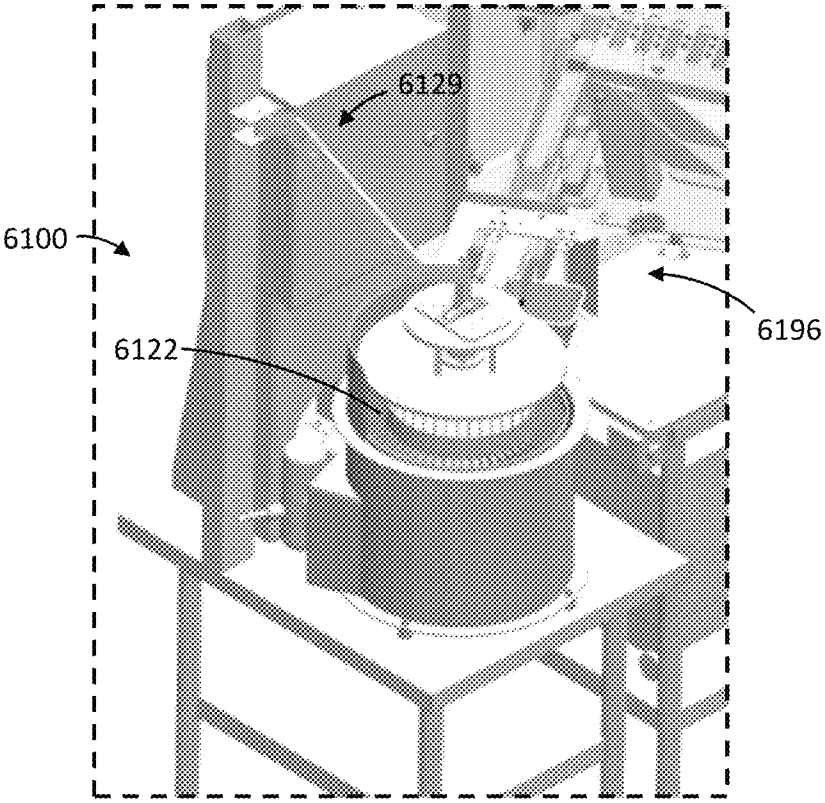
FIG. 22B is another perspective view of the apparatus of FIG. 22A, showing a pin portion in a second configuration.
Figure 22A:
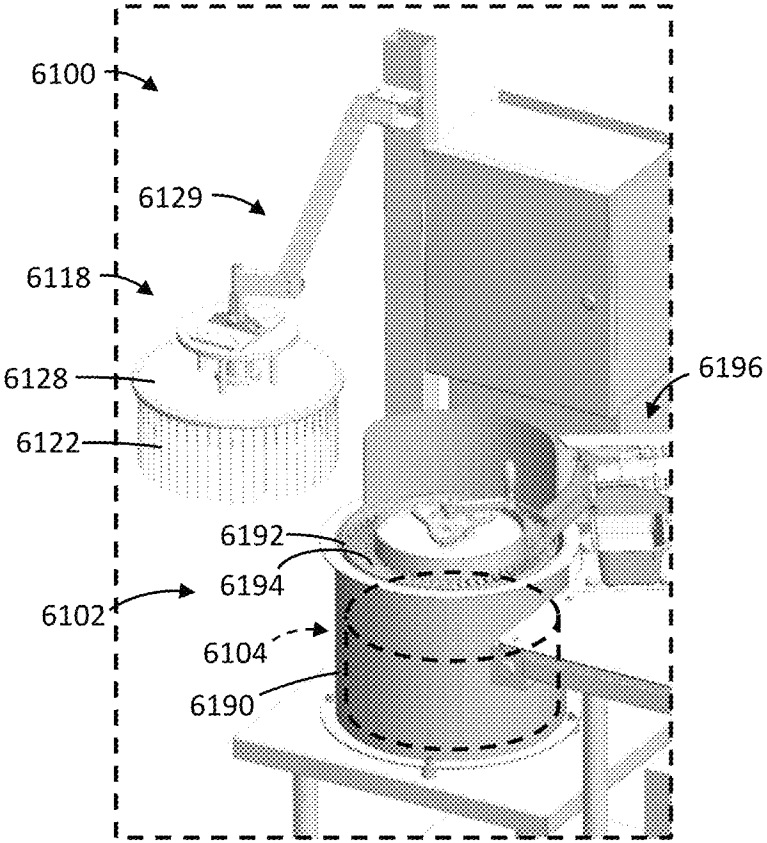
FIG. 22A is a perspective view of another example compaction apparatus, showing a pin portion in a first configuration.

In some examples, prior to step 310 of the process 300, the pallet 104 can be positioned at a cone staging station to facilitate the staging step 55 of the process 50 (FIG. 3). At the cone staging station, a cone 12 is transferred into each empty pallet cavity 106 of the pallet 104. After each cavity 106 of the pallet 104 has received a respective cone 12, the pallet 104 can be moved from the cone staging station to a cone filling station to facilitate the filling step 60 of the process 50 (FIG. 3). At the cone filling station, each cone 12 can be filled with the smokeable product 30. After each cone 12 is filled, the smokeable product 30 in the cones 12 can be compacted. In some examples, after each cone 12 is filled, the pallet 104 holding the filled cones can be moved to a cone compaction station for compacting the smokeable product 30 in the cones 12 using, for example, the apparatuses and processes disclosed herein (e.g. the apparatus 100 and process 300). In some examples, after each cone 12 is filled, the cone pallet can remain at the filling station, and the smokeable product 30 can be compacted at the filling station using a compaction apparatus such as, for example, the apparatus 6100 (FIGS. 22A and 22B).

After the smokeable product in each cone 12 is compacted, the pallet 104 can be moved from under the compaction mechanism 118, and another pallet 104 holding filled cones 12 with loose smokeable product can be positioned under the compaction mechanism 118 for compaction of smokeable product.

After the smokeable product in a pallet 104 is compacted, the pallet 104 can be moved to a cone closure station to facilitate the closing step 70 of the process 50 (FIG. 3). At the cone closure station, an upper portion of each cone 12 is twisted to close the open upper end 22 of each cone 12.

Figure 9A:
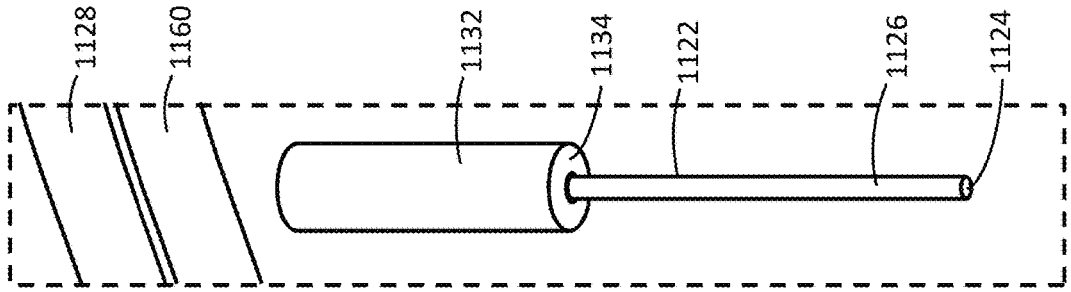
FIG. 9A is a perspective view from below of a portion of the compaction apparatus of FIG. 9.
Figure 9:
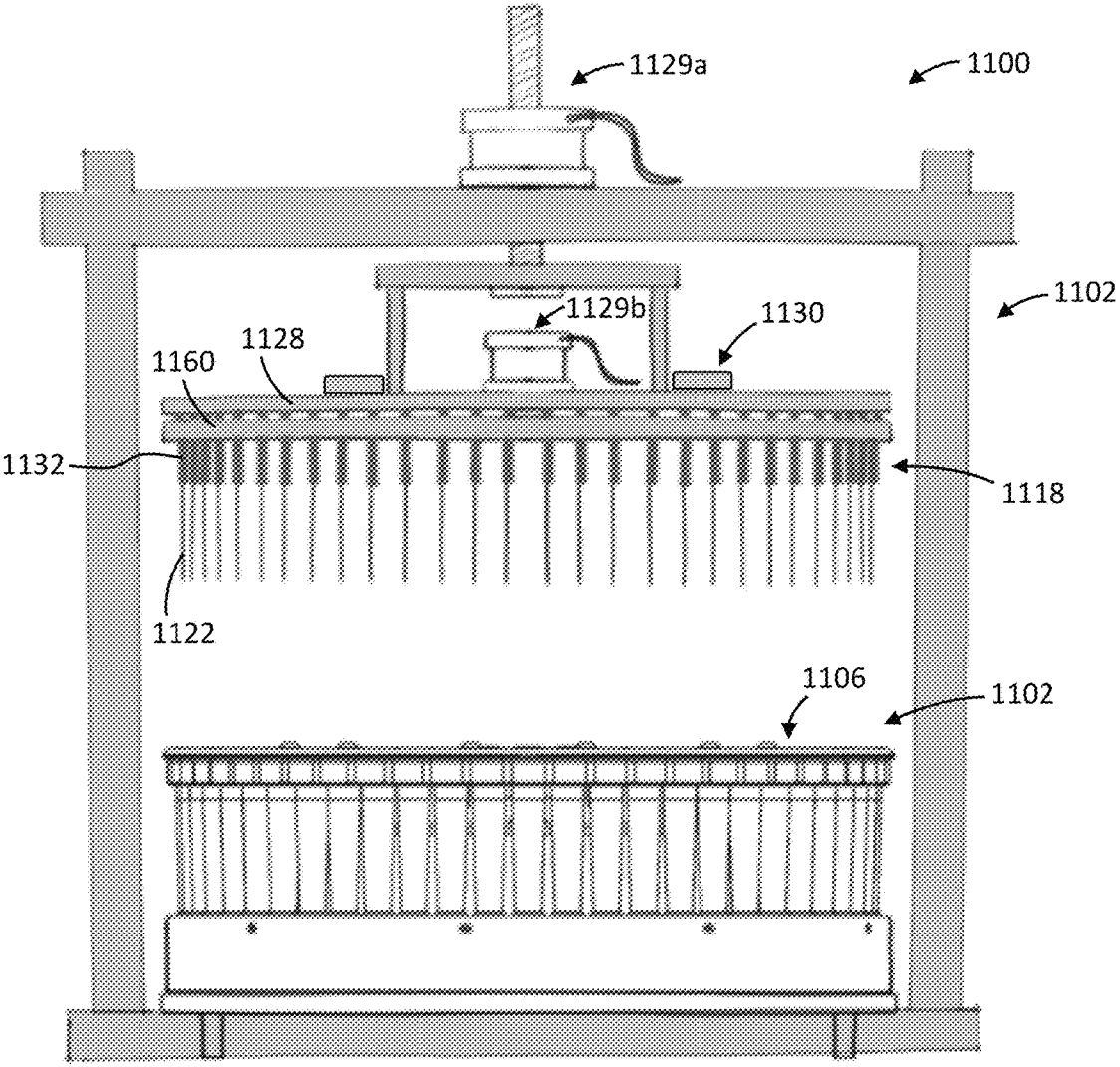
FIG. 9 is a schematic side elevation view of another example compaction apparatus, showing a pin portion of the apparatus in a retracted configuration and a tamper portion of the apparatus in a rearward configuration.

Referring to FIG. 9, another example compaction apparatus 1100 is shown. The compaction apparatus 1100 has similarities to the apparatus 100, and like features are identified with like reference characters, incremented by 1000. In the example illustrated, the compaction apparatus 1100 includes a frame 1102 for removably receiving a cone pallet 1104. The cone pallet 1104 includes a plurality of pallet cavities 1106. Each cavity 1106 holds a respective cone 12 filled with a volume of smokeable product 30 (FIG. 11A).

In the example illustrated, the apparatus 1100 includes a compaction mechanism 1118 positionable above the cone pallet 1104. The compaction mechanism 1118 can be used to compact the volume of the smokeable product 30 from a first height 32 (FIG. 11A) above the lower end 24 of the cone 12 to a second height 34 (FIG. 11C) above the lower end 24 of the cone 12 that is less than the first height 32.

Figure 11D:
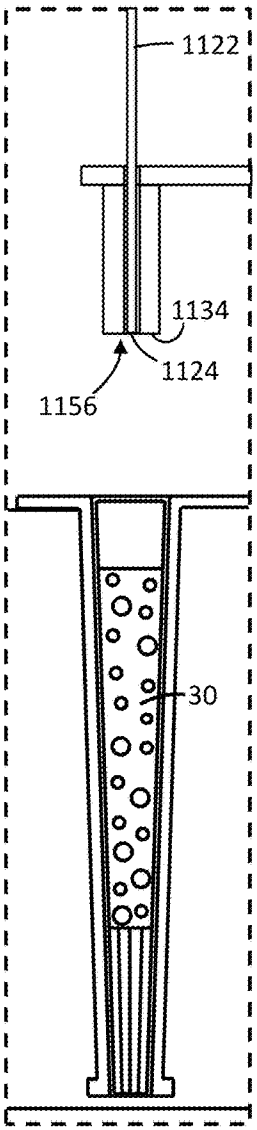
FIG. 11D is a schematic view like that of FIG. 11A, and showing the pin portion and the tamping portion forming a tamping face in a retracted configuration.
Figure 11C:
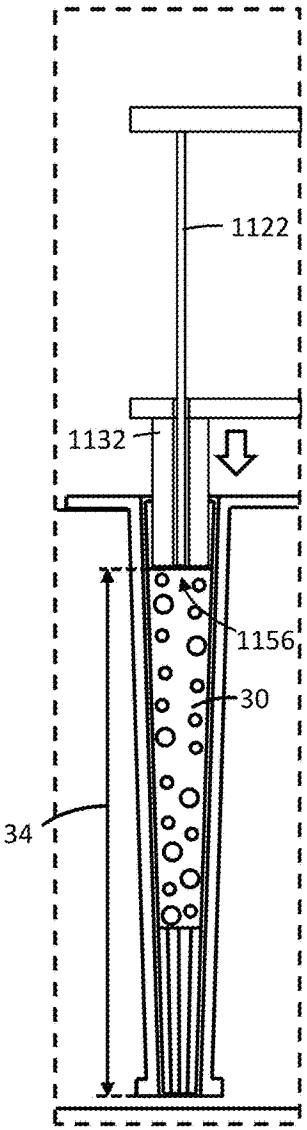
FIG. 11C is a schematic view like that of FIG. 11A, and showing the pin portion and the tamping portion forming a tamping face in an advanced configuration.
Figure 11B:
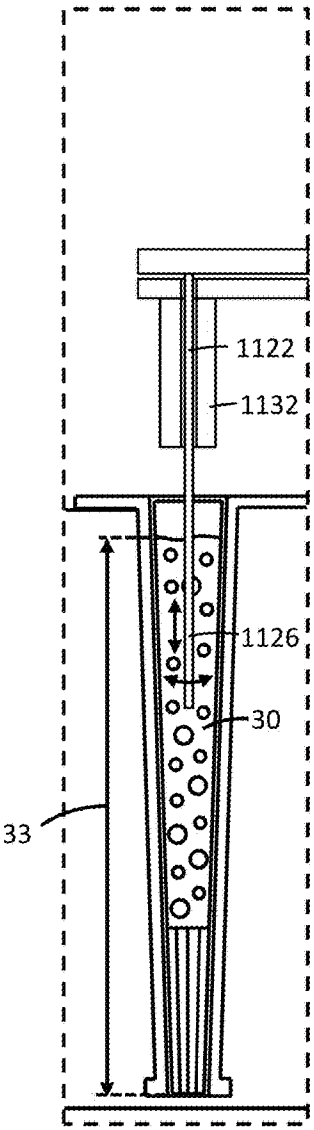
FIG. 11B is a schematic view like that of FIG. 11A, and showing the pin portion in an advanced configuration and the tamping portion in a rearward configuration.
Figure 11A:
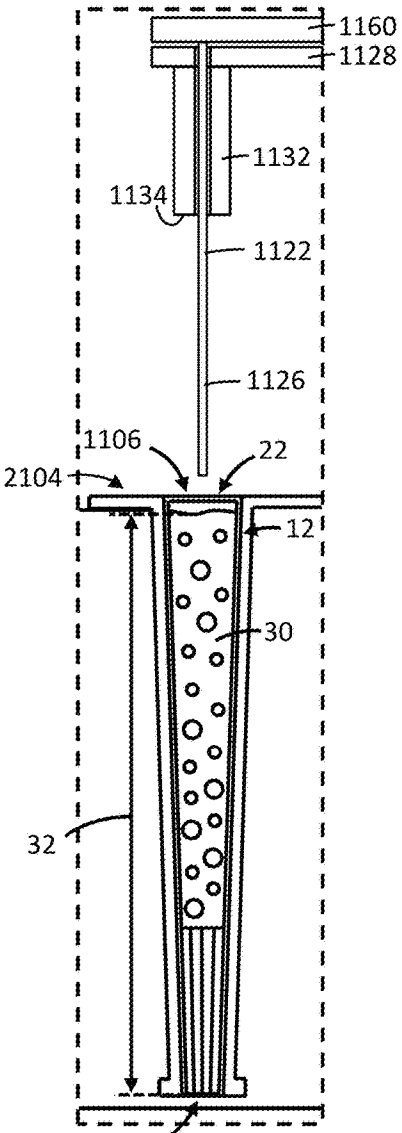
FIG. 11A is a schematic cross-sectional elevation view of a portion of the compaction apparatus of FIG. 9, showing the pin portion in a retracted configuration and the tamper portion in a rearward configuration.

Referring to FIG. 11A, the compaction mechanism 1118 includes at least one pin 1122 extending along a pin axis and alignable with an open upper end 22 of a respective cone 12 held in a respective cavity 1106. When aligned, the at least one pin 1122 is movable vertically relative to the cone pallet 1104 from a pin retracted position (FIG. 11A) distal the cone pallet 1104, toward a pin advanced position (FIG. 11B) proximate the cone pallet 1104 for inserting a lower portion 1126 of the pin 1122 into the volume of the smokeable product 30 in the respective cone 12.

Referring to FIG. 9, in the example illustrated, the compaction mechanism 1118 further includes at least one vibratory drive 1130 coupled to the pins 1122. The vibratory drive 1130 is operable to vibrate the pins 1122 when the lower portion 1126 of the pins 1122 is within the volume of the smokeable product 30 of respective cones 12. This can help induce settlement of the volume of the smokeable product 30 from the first height 32 (FIG. 11A) to an intermediate height 33 (FIG. 11B) above the lower end 24 of the cone 12 that is intermediate the first height 32 and the second height 34 (FIG. 11C).

Figure 10A:
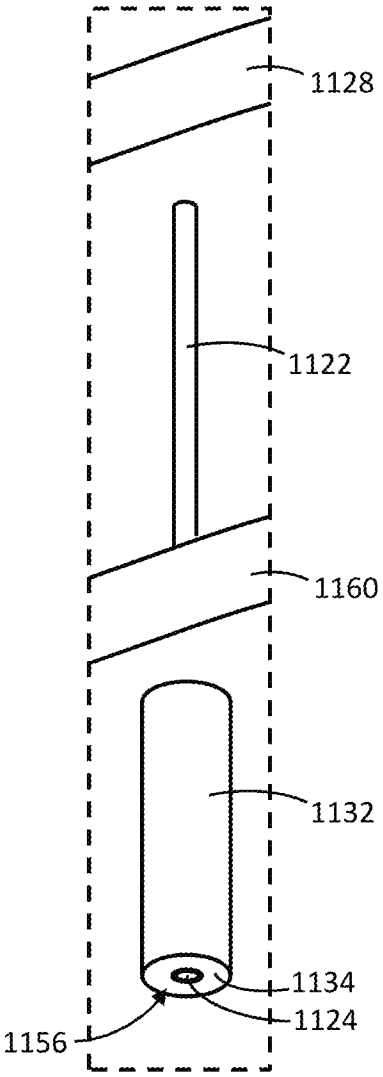
FIG. 10A is a schematic perspective view from below of a portion of the compaction apparatus of FIG. 10.

Referring to FIGS. 9 and 9A, in the example illustrated, the compaction mechanism 1118 further includes at least one tamping collar 1132 having an annular front face 1134 directed toward the cone pallet 1104 and an interior aperture open to the front face 1134 and receiving a respective pin 1122. In the example illustrated, the collar 1132 is axially movable relative to the pin 1122 between a collar rearward position (shown in FIGS. 9 and 9A) and a collar forward position (shown in FIGS. 10 and 10A). Referring to FIGS. 11A and 11B, when the collar is in the rearward position, the lower portion 1126 of the pin 1122 projects downwardly from the front face 1134 of the collar 1132 to facilitate movement of the pin toward the pin advanced position (FIG. 11B). Referring to FIG. 10A, when the collar 1132 is in the forward position, the annular front face 1134 of the collar 1132 and a tip 1124 of the pin 1122 form a tamping face 1156. Referring to FIG. 11C, the tamping face 1156 is moveable toward a tamping advanced position proximate the cone pallet 1104 to urge the tamping face 1156 downwardly against an upper surface of the smokeable product 30 to exert a compressive force thereon. This can facilitate compaction of the volume of the smokeable product 30 from the intermediate height 33 (FIG. 11B) to the second height (FIG. 11C).

Referring to FIG. 11D, the tamping face 1156 is movable from the tamping advanced position to a tamping retracted position distal the cone pallet 1104, and in which the tamping face 1156 is spaced apart from the volume of the smokeable product 30. In the example illustrated, the annular front face 1134 of the collar and the tip 1124 of the pin 1122 are generally flush when the collar is in the forward position.

Referring to FIG. 9, in the example illustrated, the compaction mechanism 1118 includes a pin carrier 1128 supported by the frame 1102 and holding the at least one pin 1122. In the example illustrated, the compaction mechanism 1118 includes a first actuator 1129*a* operable to translate the at least one pin 1122 between the pin advanced and retracted positions. In the example illustrated, the first actuator 1129*a* is operable to translate the pin carrier 1128 relative to the cone pallet 1104 for translating the pin 1122. In the example illustrated, the first actuator 1129*a* extends between the frame 1102 and the pin carrier 1128 for translating the pin carrier 1128 relative to the frame 1102.

Figure 10:
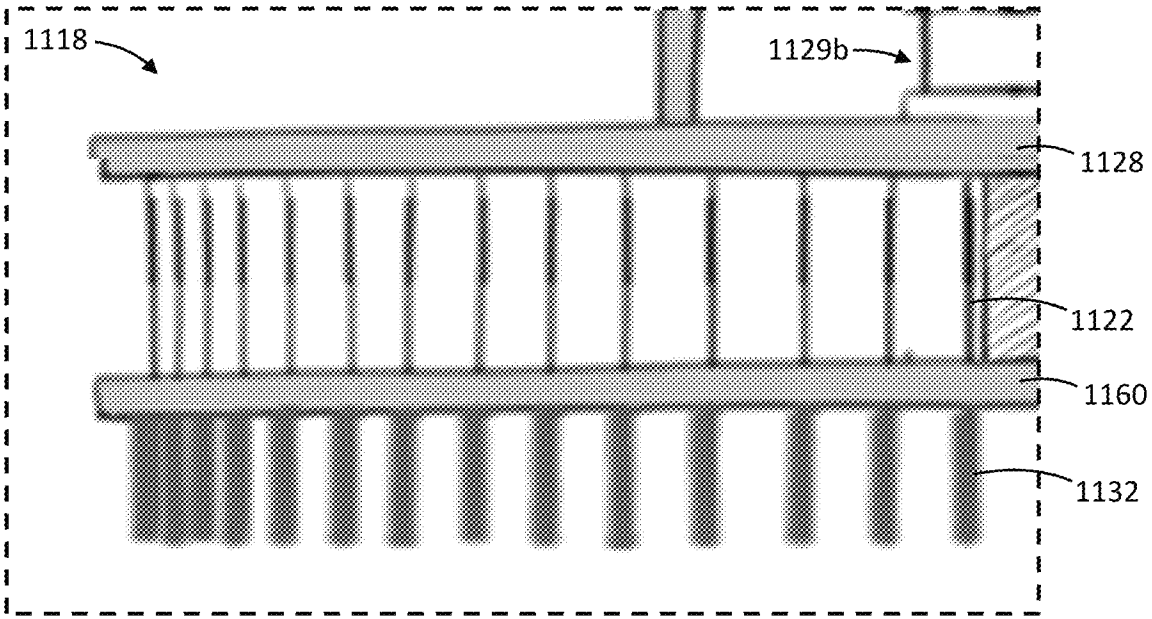
FIG. 10 is an enlarged view of a portion of the compaction apparatus of FIG. 9, and showing the pin portion in a retracted configuration and the tamper portion in a forward configuration.

Referring to FIGS. 9 and 10, the compaction mechanism 1118 further includes a tamper carrier 1160 supported by the frame 1102 and holding the at least one tamping collar 1132. In the example illustrated, the compaction mechanism 1118 includes a second actuator 1129*b* operable to move the at least one tamping collar 1132 between the rearward and forward positions. In the example illustrated, the second actuator 1129*b* is operable to translate the tamper carrier 1160 relative to the pin carrier 1128 for moving the at least one collar 1132 between the rearward and forward positions. In the example illustrated, the tamper carrier 1160 is releasably fixable in position relative to the pin carrier 1128 when the collar 1132 is in the forward position.

In the example illustrated, the tamper carrier 1160 and the second actuator 1129*b* are supported by the pin carrier 1128, and the first actuator 1129*a* is operable to move the pin carrier 1128, the tamper carrier 1160, and the second actuator 1129*b* relative to the cone pallet 1104. When the tamping collar 1132 is in the forward position, the first actuator 1129*a* is operable to move the tamping face 1156 toward the tamping advanced position.

In the example illustrated, the compaction mechanism 1118 includes a plurality of the pins 1122, with each pin 1122 in alignment with the open upper end 22 of a respective cone 12 (and with the open upper end of a respective cavity 1106 holding the cone 12). In the example illustrated, each of the pins 1122 is held by the pin carrier 1128.

In the example illustrated, the compaction mechanism 1118 includes a plurality of the tamping collars 1132, with each tamping collar 1132 receiving a respective pin 1122. In the example illustrated, each of the tamping collars 1132 is held by the tamper carrier 1160. In the example illustrated, the quantity of the tamping collars 1132, the quantity of the pins 1122, and the quantity of the cones 12 (and pallet cavities 1106) is equal.

Figure 12:
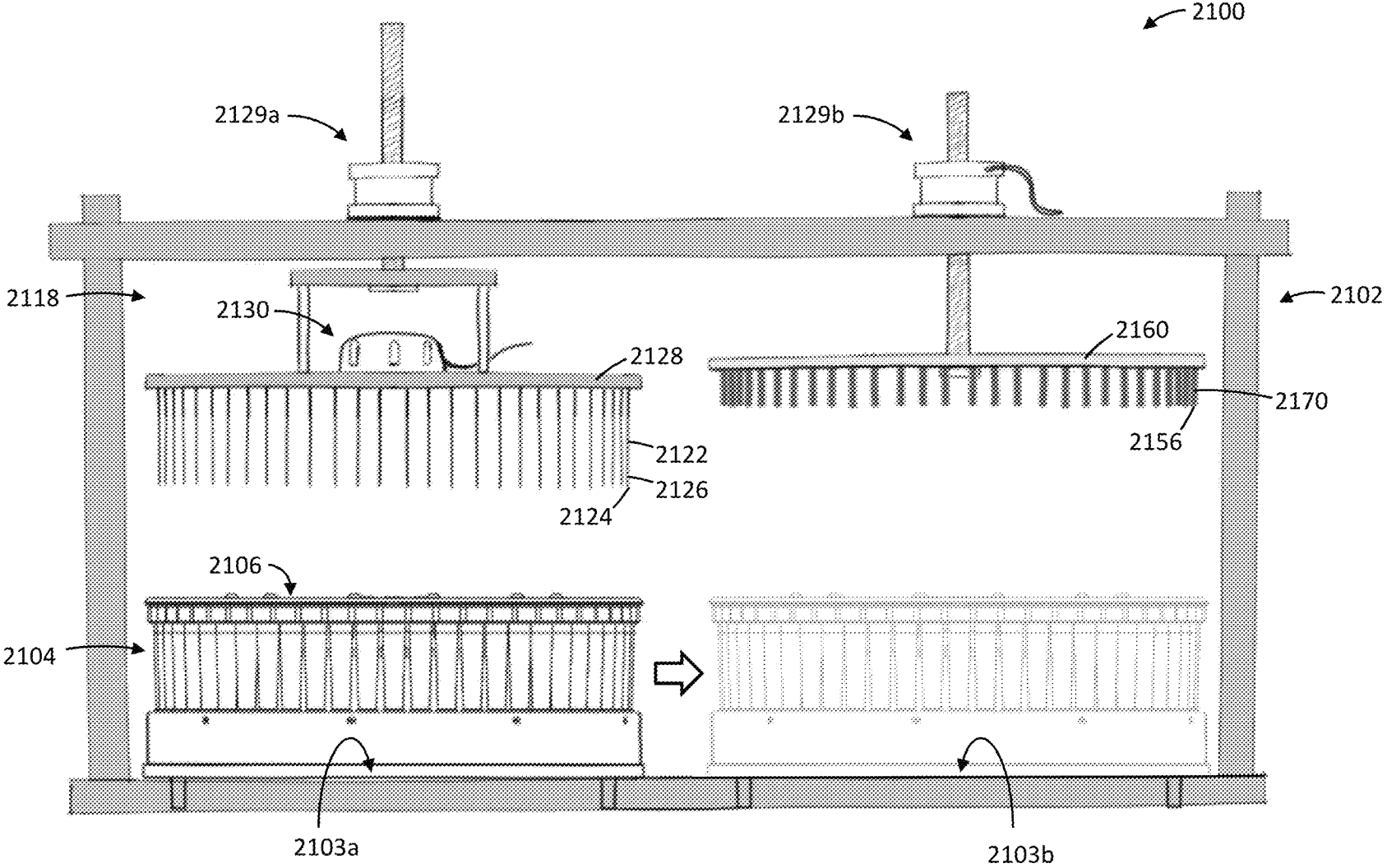
FIG. 12 is a schematic side elevation view of another example compaction apparatus.

Referring to FIG. 12, another example compaction apparatus 2100 is shown. The compaction apparatus 2100 has similarities to the apparatus 1100, and like features are identified with like reference characters, incremented by 1000.

Figure 13B:
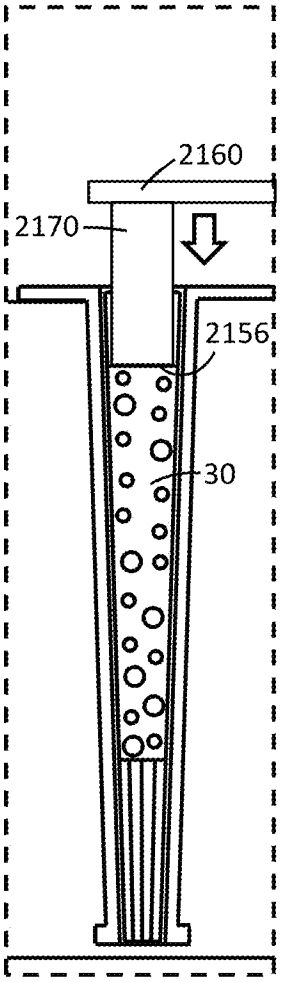
FIG. 13B is a schematic view like that of FIG. 13A, and showing the tamping portion in an advanced configuration.
Figure 13A:
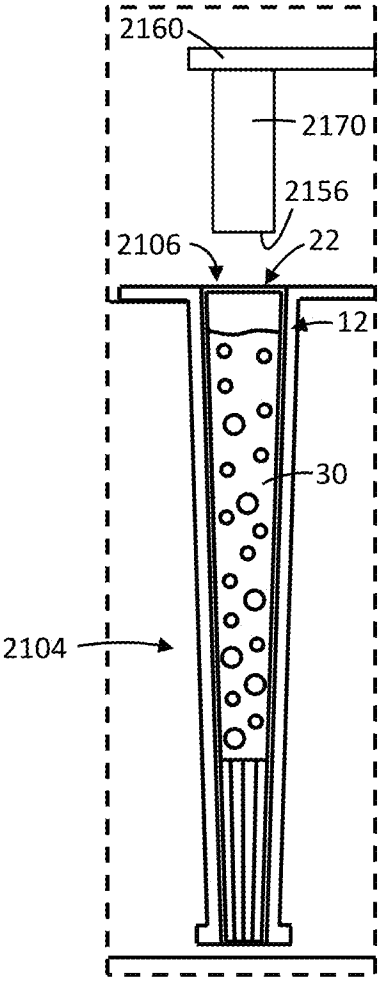
FIG. 13A is a schematic cross-sectional elevation view of a portion of the compaction apparatus of FIG. 12, showing a tamping portion of the apparatus in a retracted configuration.

In the example illustrated, the compaction apparatus 2100 includes a frame 2102 for removably receiving a cone pallet 2104. The cone pallet 2104 includes a plurality of pallet cavities 2106. Referring to FIG. 13A, each cavity 2106 holds a respective cone 12 filled with a volume of smokeable product 30. Referring to FIG. 12, in the example illustrated, the apparatus 2100 includes a compaction mechanism 2118 positionable above the cone pallet 2104. The compaction mechanism 2118 includes at least one pin 2122 alignable with the open upper end of a respective cone 12 (and with the cavity 2106). When aligned, the pin 2122 is movable vertically relative to the cone pallet 2104 from a pin retracted position toward a pin advanced position. In the example illustrated, the compaction mechanism 2118 further includes at least one vibratory drive 2130 operable to vibrate the at least one pin 2122.

In the example illustrated, the compaction mechanism 2118 includes at least one tamping rod 2170 spaced apart from the pin 2122 and having a tamping face 2156 alignable with the open upper end 22 of the respective cone 12 (and with the pallet cavity 2106). Referring to FIGS. 13A and 13B, when aligned, the tamping face 2156 is movable relative to the cone pallet 2104 between a tamping retracted position (FIG. 13A) distal the cone pallet 2104 and a tamping advanced position (FIG. 13B) proximate the cone pallet 2104. When in the tamping retracted position, the tamping face 2156 is spaced apart from the smokeable product 30 in the respective cone 12 (and from the pallet cavity 2106). The tamping face 2156 is moveable toward to the tamping advanced position to urge the tamping face 2156 downwardly against an upper surface of the smokeable product 30 in the cone 12 to exert a compressive force thereon. In the example illustrated, the pin 2122 has a tip 2124 (FIG. 12) having a pin tip diameter, and the tamping face 2156 has a tamping face diameter that is greater than the pin tip diameter.

Referring to FIG. 12, in the example illustrated, the frame 2102 defines a first station 2103*a* below the at least one pin 2122 and a second station 2103*b* below the at least one tamping rod 2170 and spaced horizontally apart from the first station 2103*a*. In the example illustrated, the cone pallet 2104 is moveable relative to the frame 2102 between the first station 2103*a* and the second station 2103*b*. When the cone pallet 2104 is in the first station 2103*a*, the at least one pin 2122 is in alignment with the open upper end 22 of a respective cone 12 (and with a respective pallet cavity 2106), and the pin 2122 is movable toward the pin advanced position for insertion of the lower portion 2126 into the volume of the smokeable product 30. When the cone pallet 2104 is in the second station 2103*b*, the tamping face 2156 of the at least one rod 2170 is in alignment with the open upper end 22 of the cone 12 (and with a respective pallet cavity 2106), and the tamping face 2156 is movable toward the tamping advanced position to exert the compressive force on the upper surface of the smokeable product 30.

In the example illustrated, the compaction mechanism 2118 includes a plurality of the pins 2122 held by a pin carrier 2128. When the cone pallet 2104 is in the first station 2103*a*, each pin 2122 is in alignment with the open upper end 22 of a respective cone 12 (and with a respective cavity 2106). In the example illustrated, the quantity of pins 2122 is equal to the quantity of cones 12 (and pallet cavities 2106). In the example illustrated, the compaction mechanism 2118 includes a first actuator 2129*a* operable to translate the at least one pin 2122 between the pin advanced and retracted positions. In the example illustrated, the first actuator 2129*a* is operable to translate the pin carrier 2128 relative to the cone pallet 2104 for translating the pin 2122.

In the example illustrated, the compaction mechanism 2118 includes a plurality of the tamping rods 2170 held by a tamper carrier 2160. When the cone pallet 2104 is in the second station 2103*b*, each tamping face 2156 is in alignment with the open upper end 22 of a respective cone 12 (and with a respective pallet cavity 2106). In the example illustrated, the quantity of tamping rods 2170 is equal to the quantity of cones 12 (and pallet cavities 2106). In the example illustrated, the compaction mechanism 2118 includes a second actuator 2129*b* operable to translate the tamping faces 2156 between the tamping advanced and retracted positions. In the example illustrated, the second actuator 2129*b* is operable to translate the tamper carrier 2160 relative to the cone pallet 2104 for translating the tamping faces 2156.

Figure 14:
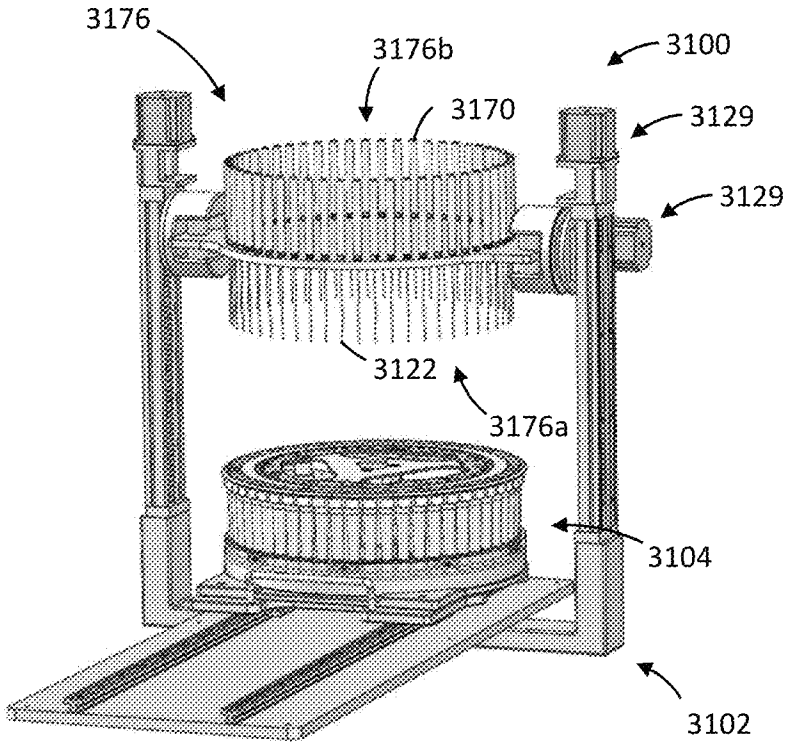
FIG. 14 is a perspective view of another example compaction apparatus, showing a rotatable carriage of the apparatus raised and in a first configuration.

Referring to FIG. 14, another example compaction apparatus 3100 is shown. The compaction apparatus 3100 has similarities to the apparatus 2100, and like features are identified with like reference characters, incremented by 1000.

Figure 15:
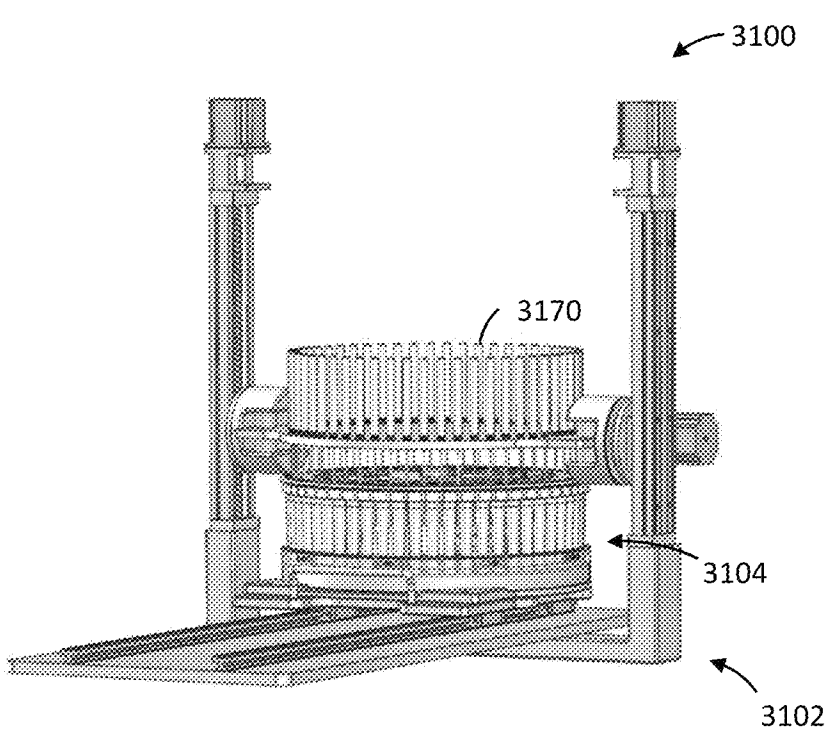
FIG. 15 is a perspective view like that of FIG. 14, and showing the carriage lowered and in the first configuration.

In the example illustrated, the compaction apparatus 3100 includes a frame 3102 for removably receiving a cone pallet 3104. The cone pallet 3104 includes a plurality of pallet cavities 3106. In the example illustrated, the apparatus 3100 includes a compaction mechanism 3118 positionable above the cone pallet 3104. In the example illustrated, the compaction mechanism 3118 includes at least one pin 3122 alignable with the open upper end of a respective cone (and with the pallet cavity). Referring to FIGS. 14 and 15, when aligned, the pin 3122 is movable vertically relative to the cone pallet 3104 from a pin retracted position (FIG. 14) toward a pin advanced position (FIG. 15). In the example illustrated, the compaction mechanism 3118 further includes at least one vibratory drive operable to vibrate the pins 3122.

Figure 17:
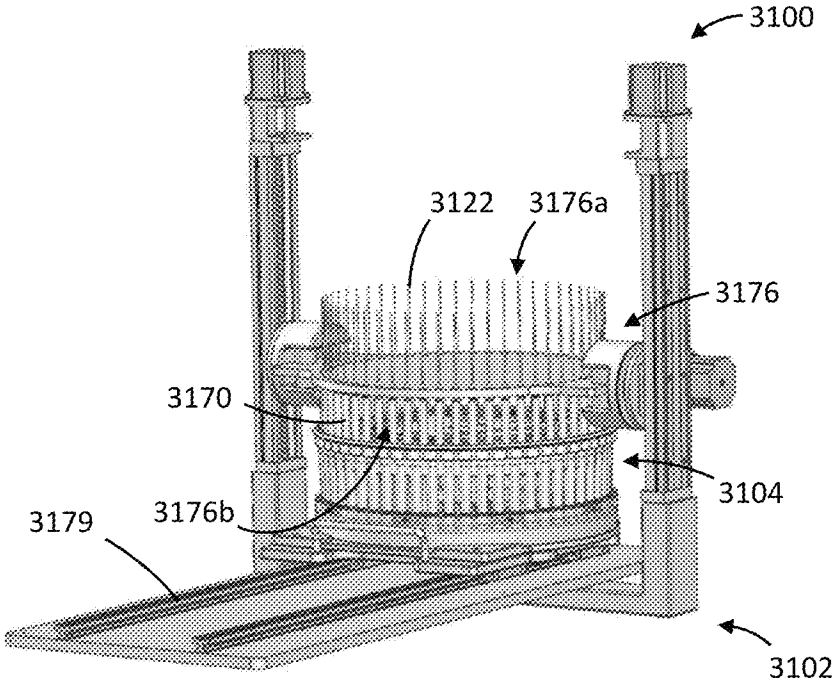
FIG. 17 is a perspective view like that of FIG. 14, and showing the carriage lowered and in the second configuration.

In the example illustrated, the compaction mechanism 3118 includes at least one tamping rod 3170 spaced apart from the pin 3122 and having a tamping face 3156 (FIG. 16) alignable with the open upper end of the respective cone (and with the pallet cavity). Referring to FIG. 17, when aligned, the tamping face 3156 is movable relative to the cone pallet 3104 between a tamping retracted position and a tamping advanced position (shown in FIG. 17).

Figure 16:
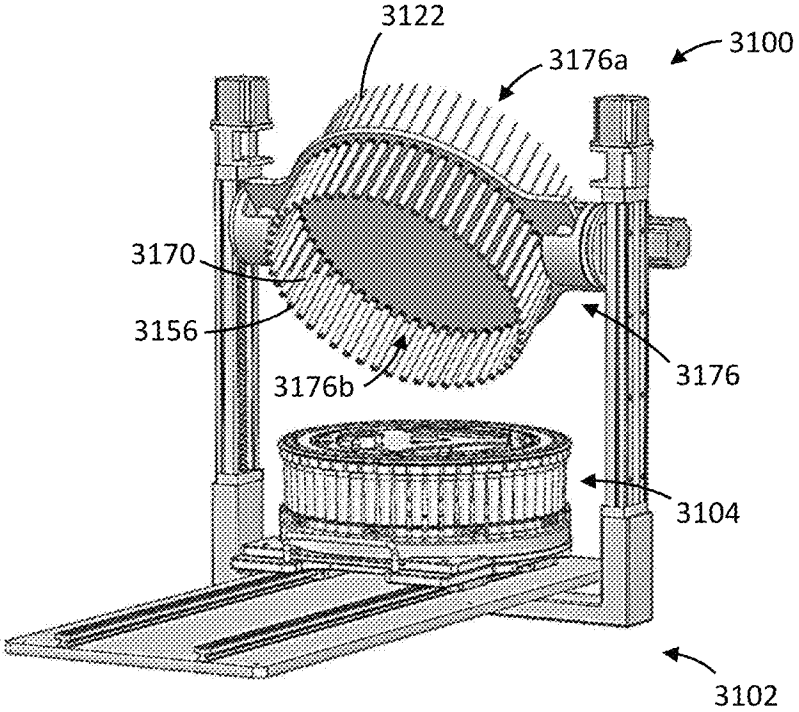
FIG. 16 is a perspective view like that of FIG. 14, and showing the carriage raised and transitioning between first and second configurations.

Referring to FIG. 16, in the example illustrated, the compaction mechanism 3118 includes a rotatable carriage 3176 mounted to the frame 3102 and holding the pins 3122 and rods 3170. The carriage 3176 has a first side 3176*a* and a second side 3176*b* spaced rotationally apart from the first side 3176*a*. In the example illustrated, the second side 3176*b* is generally opposite the first side, spaced rotationally apart from the first side 3176*a* by about 180 degrees. In the example illustrated, the at least one pin 3122 projects from the first side 3176*a* and the at least one tamping rod 3170 projects from the second side 3176*b*. The carriage 3176 is rotatable relative to the frame 3102 between a first rotary position and a second rotary position. Referring to FIGS. 14 and 15, when the carriage is in the first rotary position, the first side 3176*a* and the at least one pin 3122 are directed downwardly and the pin 3122 is in alignment with a respective pallet cavity (and the open upper end of a respective cone held therein). Referring to FIG. 17, when the carriage 3176 is in the second rotary position, the second side 3176*b* and the tamping face 3156 (FIG. 16) of the at least one tamping rod 3170 are directed downwardly and the tamping face 3156 is in alignment with the open upper end of the cone (and pallet cavity).

In the example illustrated, the carriage 3176 is vertically translatable relative to the cone pallet 3104 for moving the pin 3122 between the pin advanced and pin retracted positions when the carriage is in the first rotary position, and for moving the tamping face 3156 between the tamping advanced and tamping retracted positions when the carriage in the second rotary position. In the example illustrated, the compaction mechanism 3118 includes one or more actuators 3129 for rotating the carriage between the first and second rotary positions, and for vertically translating the carriage 3176 relative to the cone pallet 3104. In the example illustrated, the carriage 3176 is also vertically translatable relative to the frame 3102. In the example illustrated, the cone pallet 3104 is horizontally translatable along one or more rails 3179 between a cone pallet retracted position and a cone pallet advanced position. When in the cone pallet retracted position, the cone pallet 3104 is clear of the carriage 3176 (e.g. to facilitate loading and unloading the cone pallet 3104 into and out from the apparatus 3100). When in the cone pallet advanced position, the cone pallet 3104 is positioned under the carriage 3176 for alignment with the pins 3122 (when the carriage 3176 is in the first rotary position) or the tamping faces 3156 (when the carriage 3176 is in the second rotary position).

Figure 18:
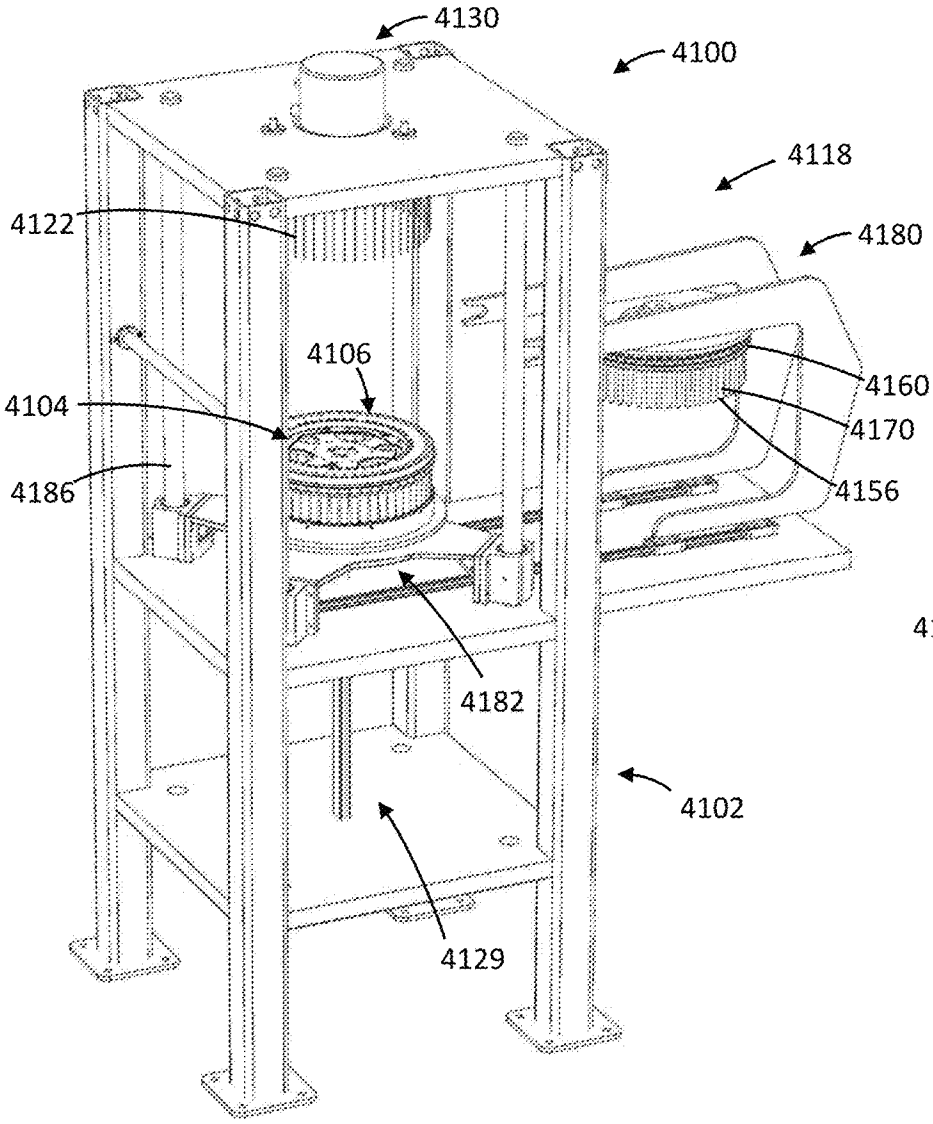
FIG. 18 is a perspective view of another example compaction apparatus, showing a translatable carriage of the apparatus in a retracted configuration.

Referring to FIG. 18, another example compaction apparatus 4100 is shown. The compaction apparatus 4100 has similarities to the apparatus 3100, and like features are identified with like reference characters, incremented by 1000.

In the example illustrated, the compaction apparatus 4100 includes a frame 4102 for removably receiving a cone pallet 4104 having a plurality of pallet cavities 4106. In the example illustrated, the apparatus 4100 includes a compaction mechanism 4118 positionable above the cone pallet 4104. In the example illustrated, the compaction mechanism 4118 includes at least one pin 4122 alignable with the open upper end of a respective cone (and pallet cavity 4106). When aligned, the pin 4122 is movable vertically relative to the cone pallet 4104 from a pin retracted position toward a pin advanced position. In the example illustrated, the compaction mechanism 4118 includes a plurality of the pins 4122 held by a pin carrier. In the example illustrated, the compaction mechanism 4118 further includes at least one vibratory drive 4130 operable to vibrate the pins 4122 (e.g. through vibration of the pin carrier).

Figure 19:
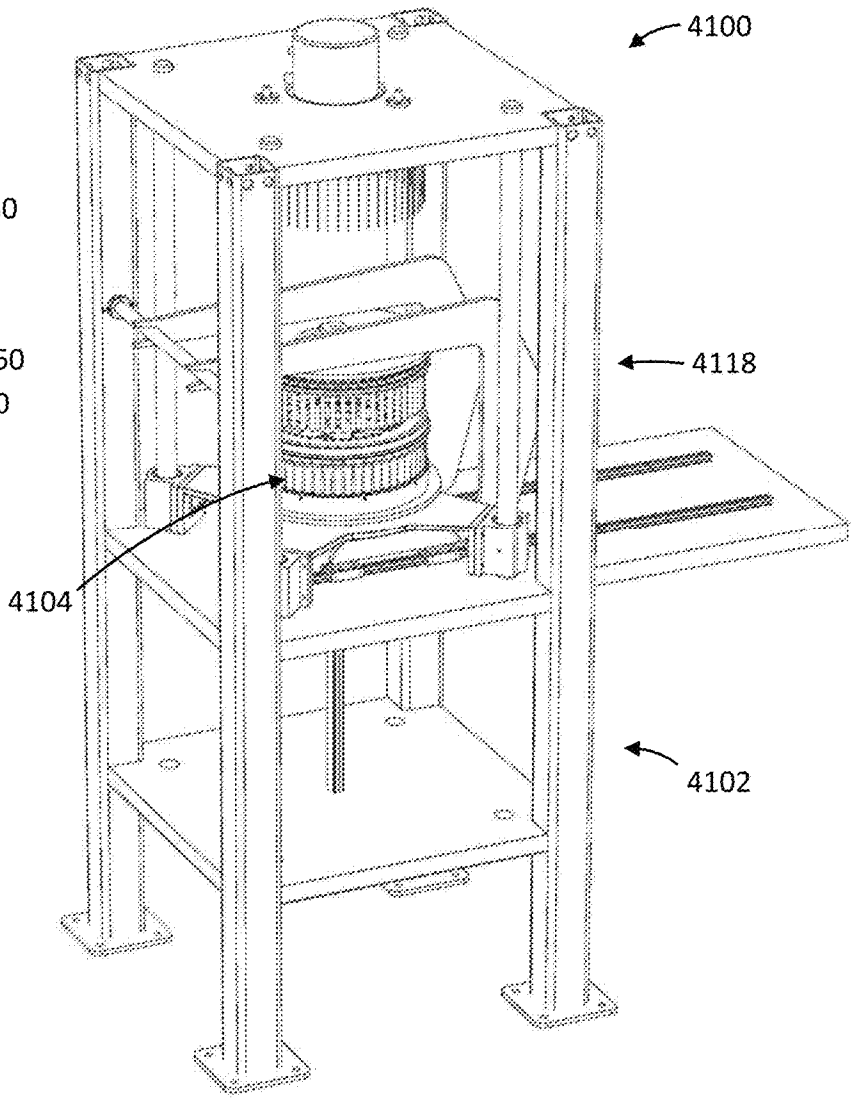
FIG. 19 is a perspective view like that of FIG. 18, and showing the carriage in an advanced configuration.

In the example illustrated, the compaction mechanism 4118 includes at least one tamping rod 4170 spaced apart from the pin 4122 and having a tamping face 4156 alignable with the open upper end of the respective cone (and pallet cavity 4106). Referring to FIG. 19, when aligned, the tamping face 4156 is movable relative to the cone pallet 4104 between a tamping retracted position and a tamping advanced position for exerting a compressive force on an upper surface of the smokeable product. In the example illustrated, the compaction mechanism 4118 includes a plurality of the tamping rods 4170 held by a tamper carrier 4160 (FIG. 18).

Referring to FIG. 18, in the example illustrated, the compaction mechanism 4118 includes a carriage 4180 movably supported by the frame 4102, and one of the at least one pin 4122 and the at least one tamping rod 4170 is mounted to the carriage 4180. In the example illustrated, the other one of the at least one pin 4122 and the at least one tamping rod 4170 is supported by the frame 4102 above the cone pallet 4104 and in alignment with the open upper end of a respective cone (and a respective pallet cavity 4106). In the example illustrated, the tamper carrier 4160 and the plurality of tamping rods 4170 are mounted to the carriage 4180, and the pin carrier and the plurality of pins 4122 are supported by the frame 4102 above the cone pallet 4104.

In the example illustrated, the carriage 4180 is movable between a carriage retracted position (FIG. 18) and a carriage advanced position (FIG. 19). Referring to FIG. 18, when the carriage 4180 is in the carriage retracted position, the carriage 4180 and the tamping rods 4170 are horizontally clear of the cone pallet 4104, and the pins 4122 are movable toward the pin advanced position. Referring to FIG. 19, when the carriage 4180 is in the carriage advanced position, the tamping faces 4156 are in alignment with the open upper end of respective cones (and cone cavities 4106) and movable toward the tamping advanced position. In the example illustrated, the tamping rods 4156 are aligned with and spaced vertically below the pins 4122 when the carriage 4180 is in the carriage advanced position.

In the example illustrated, the compaction mechanism 4118 further includes one or more actuators 4129 supported by the frame 4102 for moving the pins 4122 between the pin advanced and pin retracted positions and for moving the tamping faces 4156 between the tamping advanced and tamping retracted positions. In the example illustrated, the one or more actuators 4129 include a pallet actuator 4182 for vertically translating the cone pallet 4104 away from and towards a pallet lowered position. The pallet lowered position corresponds to the pin retracted position and the tamping retracted position. In the example illustrated, when the carriage 4180 is in the carriage retracted position, the pallet actuator 4182 is operable to raise the cone pallet 4104 from the pallet lowered position toward the pins 122 to move the pins 4122 toward the pin advanced position. In the example illustrated, when the carriage 4180 is in the carriage advanced position, the pallet actuator 4182 is operable to raise the cone pallet 4104 from the pallet lowered position toward the tamping faces 4156 to move the tamping faces 4156 toward the tamping advanced position.

In the example illustrated, pallet actuator 4182 comprises a plurality of guides 4186 fixed relative to the frame 4102 for guiding vertical movement of the cone pallet 4104. In the example illustrated, the guides 4186 comprise vertical shafts.

Figure 21:
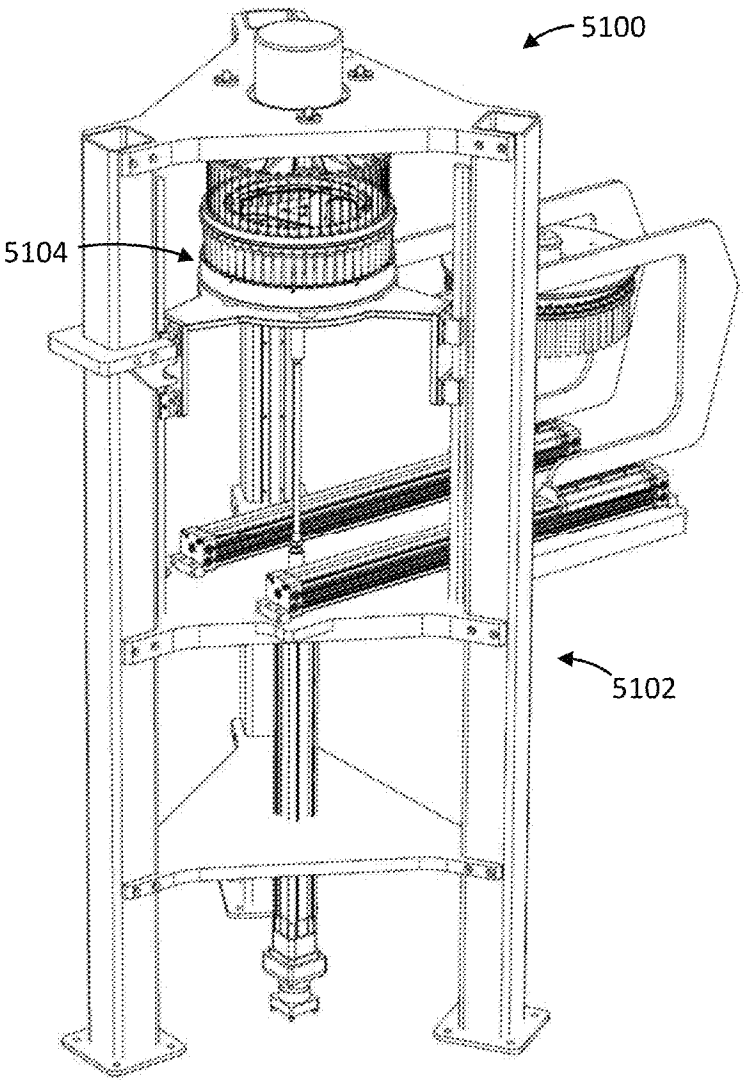
FIG. 21 is a perspective view like that of FIG. 20, and showing the pallet portion in a raised configuration.
Figure 20:
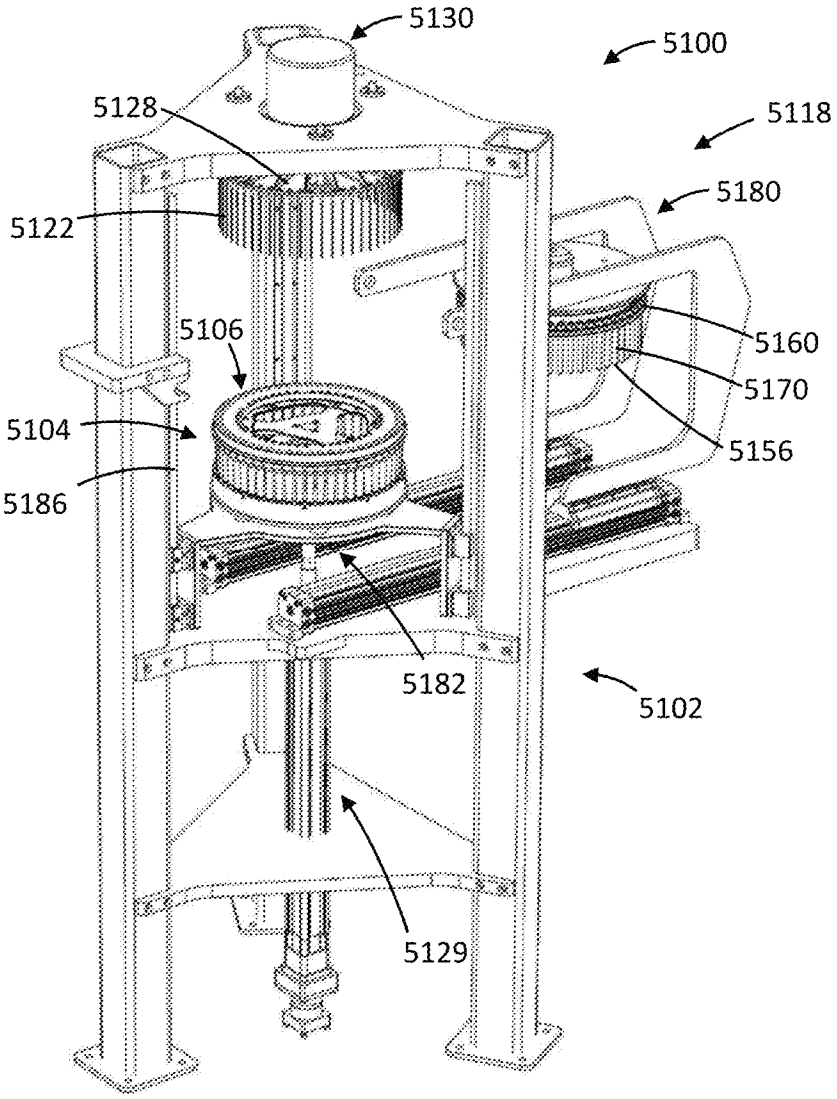
FIG. 20 is a perspective view of another example compaction apparatus, showing a pallet portion of the apparatus in a lowered configuration.

Referring to FIGS. 20 and 21, another example compaction apparatus 5100 is shown. The compaction apparatus 5100 has similarities to the apparatus 4100, and like features are identified with like reference characters, incremented by 1000.

In the example illustrated, the compaction apparatus 5100 includes a frame 5102 for removably receiving a cone pallet 5104, and a compaction mechanism 5118 positionable above the cone pallet 5104. In the example illustrated, the compaction mechanism 5118 includes: a plurality of pins 5122 held by a pin carrier 5128 and movable between a pin retracted and a pin advanced position; a vibratory drive 5130 operable to vibrate the pins 5122; a plurality of tamping rods 5170 with respective tamping faces 5156 movable between a tamping retracted position and a tamping advanced position; a carriage 5180 carrying the tamping rods 5170 and translatable between a carriage retracted position and a carriage advanced position; and one or more actuators 5129, including a pallet actuator 5182 for raising and lowering the cone pallet 5104 between a lowered position (FIG. 20) and a raised position (FIG. 21). In the example illustrated, the pallet actuator 5182 includes a plurality of guides 5186 fixed relative to the frame 5102 for guiding movement of the cone pallet 5104 between the raised and lowered positions. In the example illustrated, the guides 5186 comprise vertical rails.

Referring to FIGS. 22A and 22B, another example compaction apparatus 6100 is shown. The compaction apparatus 6100 has similarities to the apparatus 5100, and like features are identified with like reference characters, incremented by 1000.

In the example illustrated, the compaction apparatus 6100 includes a frame 6102 for removably receiving a cone pallet 6104 (shown schematically in dashed lines). The frame 6102 includes a housing 6190, and at least a portion of the cone pallet 6104 is receivable in a chamber of the housing 6190. A dosing tray 6192 is disposed above the pallet 6104 to facilitate filling of the cones (e.g. cones 12) supported in the pallet 6104 with the smokeable product. The dosing tray 6192 includes a plurality of transfer sleeves 6194. Each transfer sleeve 6194 has an upper sleeve end for receiving smokeable product from a dispensing assembly 6196, and a lower sleeve end for dispensing the smokeable product into a respective cone held in the cone pallet 6104.

In the example illustrated, the compaction apparatus 6100 includes a compaction mechanism 6118 positionable above the cone pallet 6104. The compaction mechanism 6118 includes at least one pin 6122 alignable with the open upper end of a respective cone (and pallet cavity) in the cone pallet 6104. Referring to FIG. 22B, when aligned, the at least one pin 6122 is movable vertically relative to the cone pallet 6104 between a pin retracted position and a pin advanced position. In the example illustrated, when the pin is moved from the pin retracted position toward the pin advanced position (for insertion of the pin 6122 into the smokeable product held in a respective cone in the cone pallet 6104), the pin 6122 passes through a respective transfer sleeve 6194 of the dosing tray 6192.

In the example illustrated, the compaction mechanism 6118 includes a plurality of the pins 6122 held by a pin carrier 6128, and a manipulator 6129 for moving the pin carrier 6128 relative to the cone pallet 6104. In the example illustrated, the manipulator 6129 is operable to move the pin carrier 6128 laterally between a station-clear position (FIG. 22A) in which the pin carrier 6128 is laterally spaced apart from the pallet 6104, and a station-engaged position (FIG. 22B) in which the pin carrier 6128 is in vertical registration with the pallet 6104. Moving the pin carrier to the station-clear position moves the pin carrier 6128 (and the pins 6122) clear of the cone pallet 6104 and the dosing tray 6192, which can facilitate removing filled cone pallets from the frame 6102 and inserting empty cone pallets in the frame 6102 for filling of the cones held therein with the smokeable product.

Alternatively or additionally, the manipulator 6129 can be operable to move the pin carrier 6128 vertically. In the example illustrated, the manipulator 6129 is operable to move the pin carrier 6128 vertically, and when the pin carrier 6128 is in the station-engaged position, the manipulator 6129 is operable to move the pins 6122 between the pin retracted and pin advanced positions (for compaction, as described in more detail previously). The manipulator can include one or more linear or rotary actuators, and in the example illustrated, the manipulator 6129 includes a multi-axis robot arm.

Figure 23:
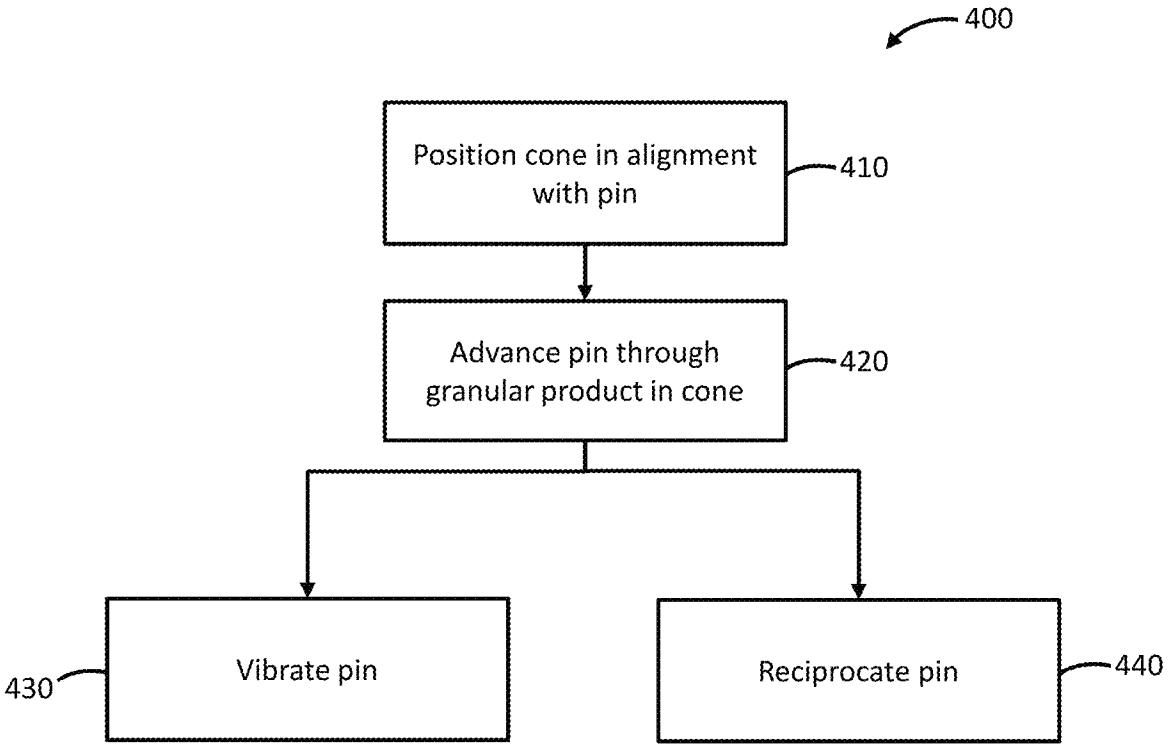
FIG. 23 is a flow chart showing another example process for mass production of conical smoking articles using a compaction apparatus like that disclosed in the present specification.

Referring to FIG. 23, an example process 400 for mass production of smoking articles using a compaction apparatus similar to the compaction apparatuses of the present specification is shown, and will be described with respect to the compaction apparatus 1100. At step 410 of the process 400, a respective cone 12 received in the cone pallet 1104 and holding a volume of the smokeable product 30 is positioned in alignment with a respective pin 1122. At step 420, the pin 1122 is advanced into the volume of the smokeable product 30 through the open upper end 22 of the cone 12. At step 430, when the pin 1122 is in the volume of the smokeable product 30, the pin 1122 is vibrated to induce settlement of the smokeable product 30.

Figure 24:
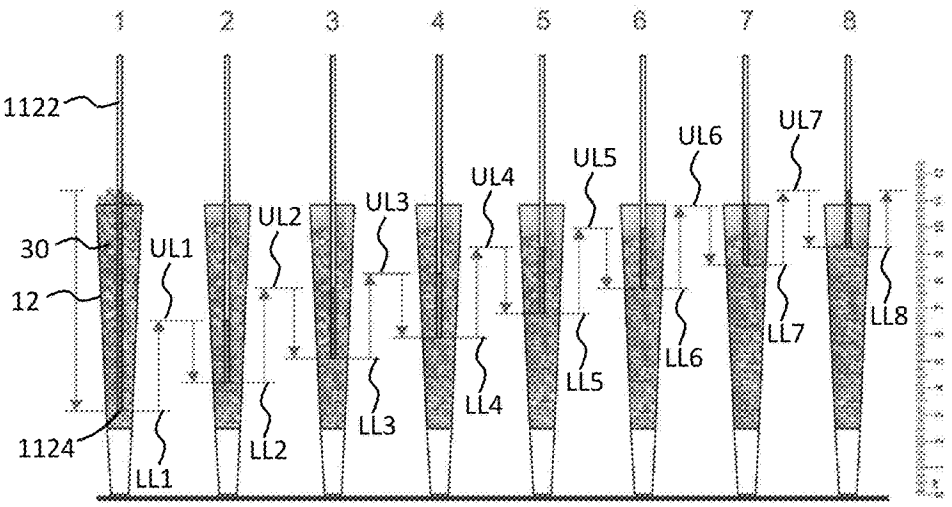
FIG. 24 is a schematic showing an example method of reciprocating a pin during a compaction process like that of FIG. 23.

At step 440, the pin 1122 is reciprocated along a vertical axis in the volume of the smokeable product 30. Referring to FIG. 24, in the example illustrated, the reciprocating step 440 includes vertically translating the tip 1124 of the pin 1122 in successive strokes over a time period between a lower limit (LL) and an upper limit (UL) above the lower limit, and raising the lower limit over the time period (e.g. from LL1 to LL8 in FIG. 24). Each stroke can have a stroke length between the lower and upper limit of, for example, at least 10 mm. In the example shown in FIG. 24, the reciprocating step 440 includes raising the upper limit over the time period (e.g. from UL1 to UL7), and coordinating the raising of the upper and lower limits to maintain a generally common stroke length of the pin 1122 over at least a portion of the time period.

Figure 25:
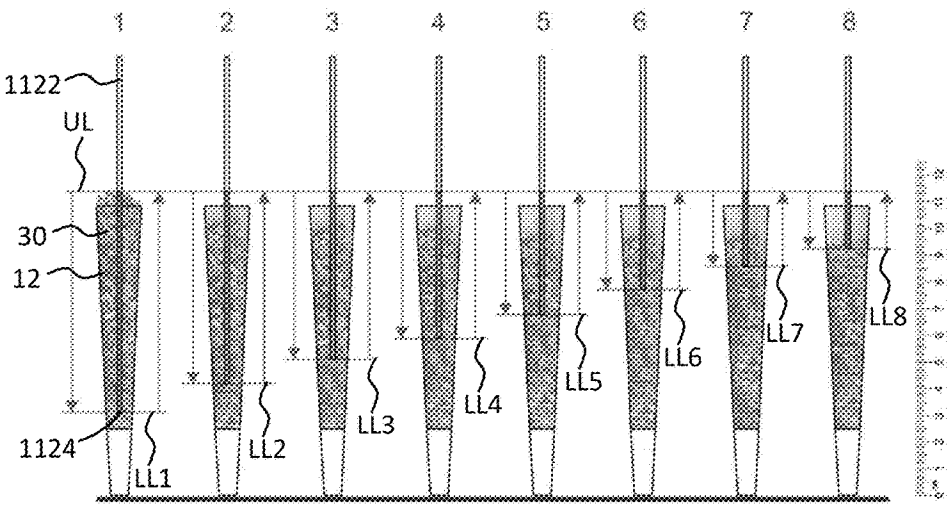
FIG. 25 is a schematic showing another example method of reciprocating a pin during a compaction process like that of FIG. 23.
Figure 27:
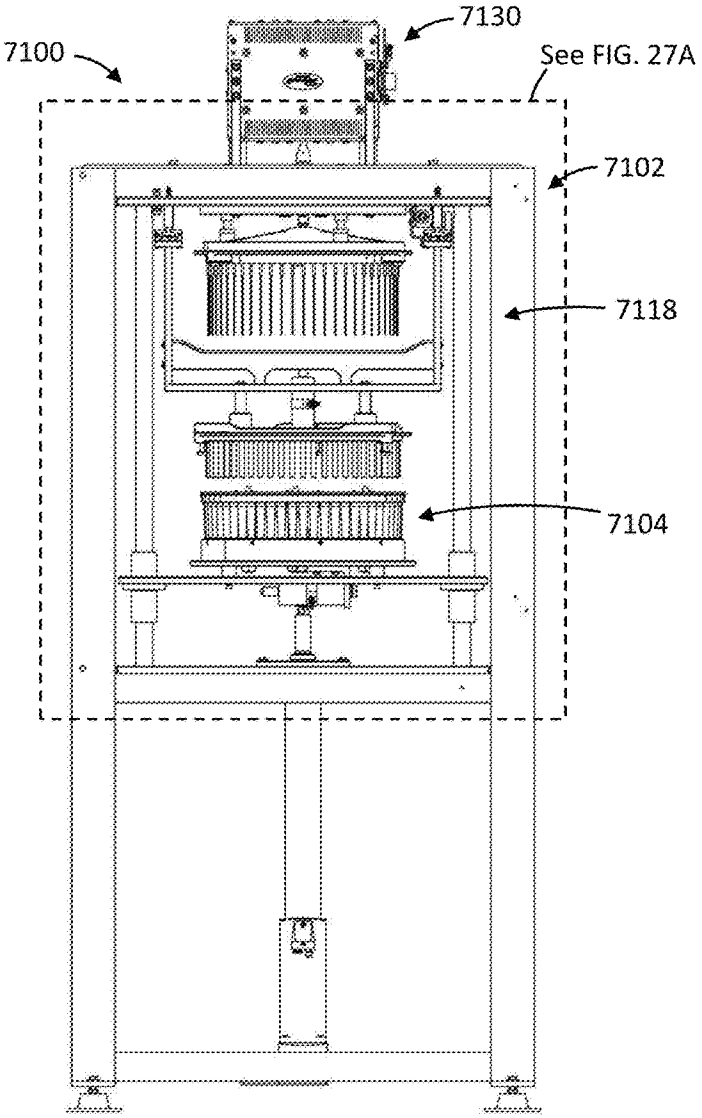
FIG. 27 is a rear elevation view of the compaction apparatus of FIG. 26, and showing the pallet portion in an intermediate configuration.

Referring to FIG. 25, in the example illustrated, the reciprocating step 440 includes maintaining the upper limit at a generally common elevation over the time period to reduce a stroke length of the pin 1122 when the lower limit is raised (e.g. from LL1 to LL8 in FIG. 25).

The process 400 can optionally include the step of, after steps 430 and 440, withdrawing the pin 1122 from the volume of the smokeable product 30 and urging the tamping face 1156 downwardly against an upper surface of the smokeable product 30 to exert a compressive force thereon.

When used with the apparatus 1100, the process 400 can optionally include the step of translating the pin 1122 relative to the tamping collar 1132 through which the pin 1122 extends to bring the tip 1124 of the pin 1122 and an annular front face 1134 of the collar 1132 into vertical alignment so that the tip 1124 of the pin 1122 and the front face 1134 form the tamping face 1156.

Figure 26:
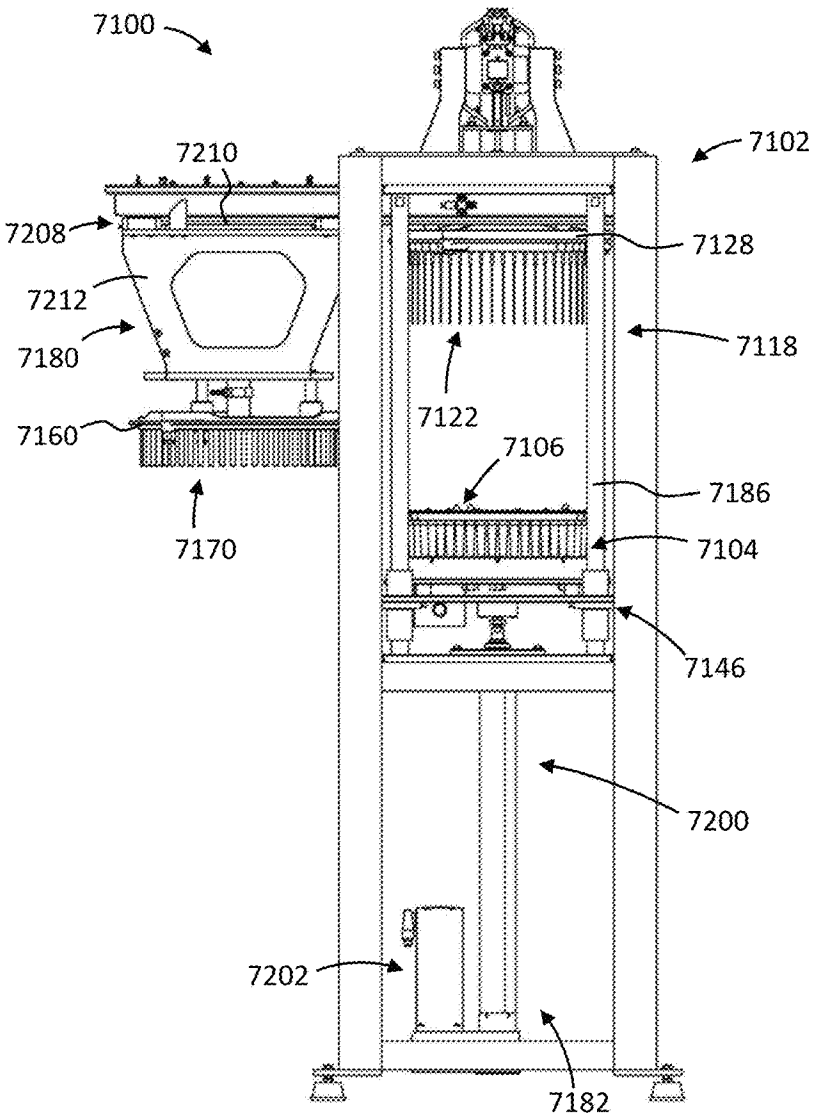
FIG. 26 is a side elevation view of another example compaction apparatus, showing a translatable carriage of the apparatus in a retracted configuration and a pallet portion of the apparatus in a lowered configuration.

Referring to FIG. 26, another example compaction apparatus 7100 is shown. The compaction apparatus 7100 has similarities to the apparatus 4100, and like features are identified with like reference characters, incremented by 3000. In the example illustrated, the compaction apparatus 7100 includes a frame 7102 for removably receiving a cone pallet 7104 having a plurality of pallet cavities 7106.

Figure 27A:
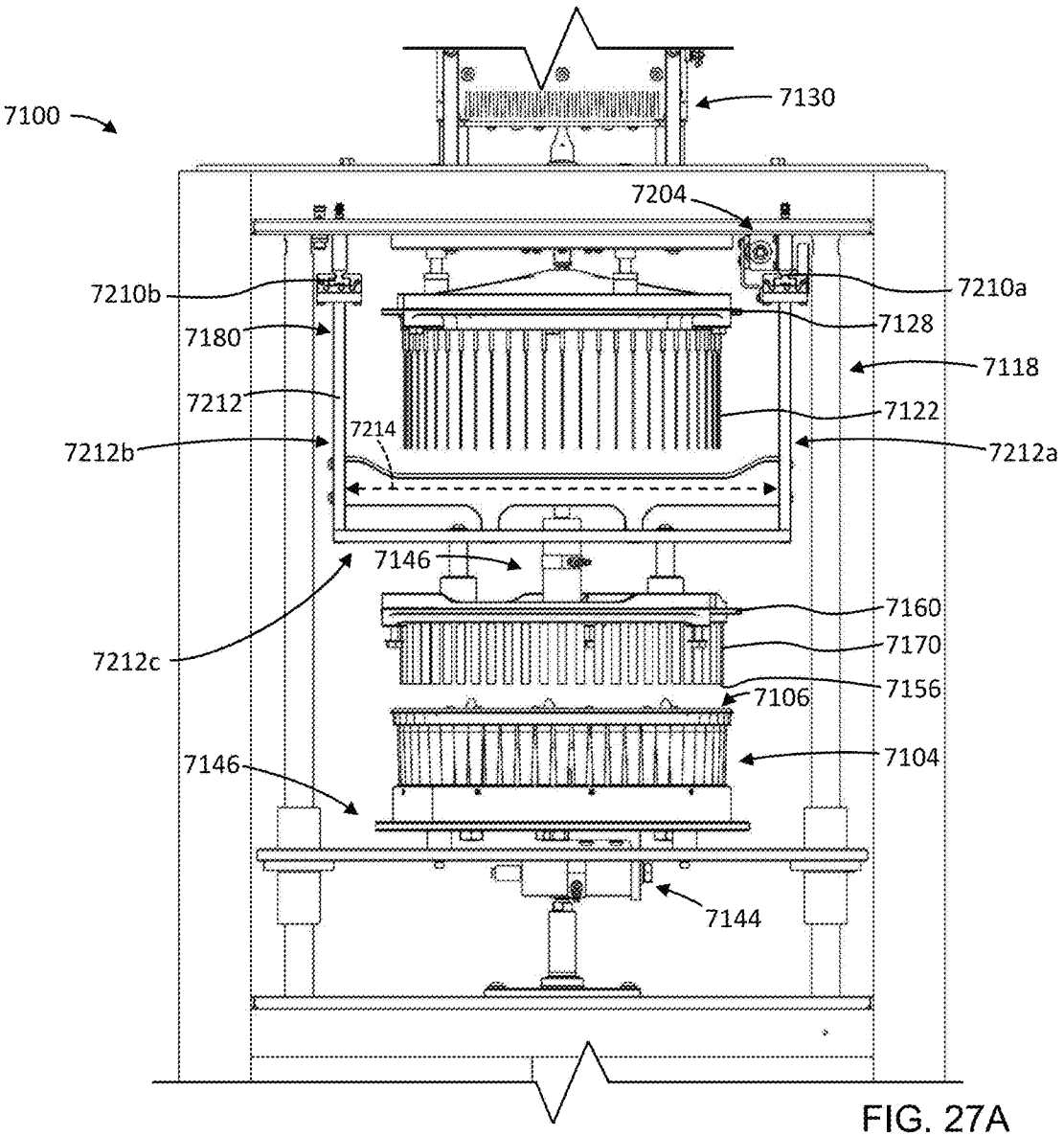
FIG. 27A is an enlarged view of a portion of FIG. 27.
Figure 32:
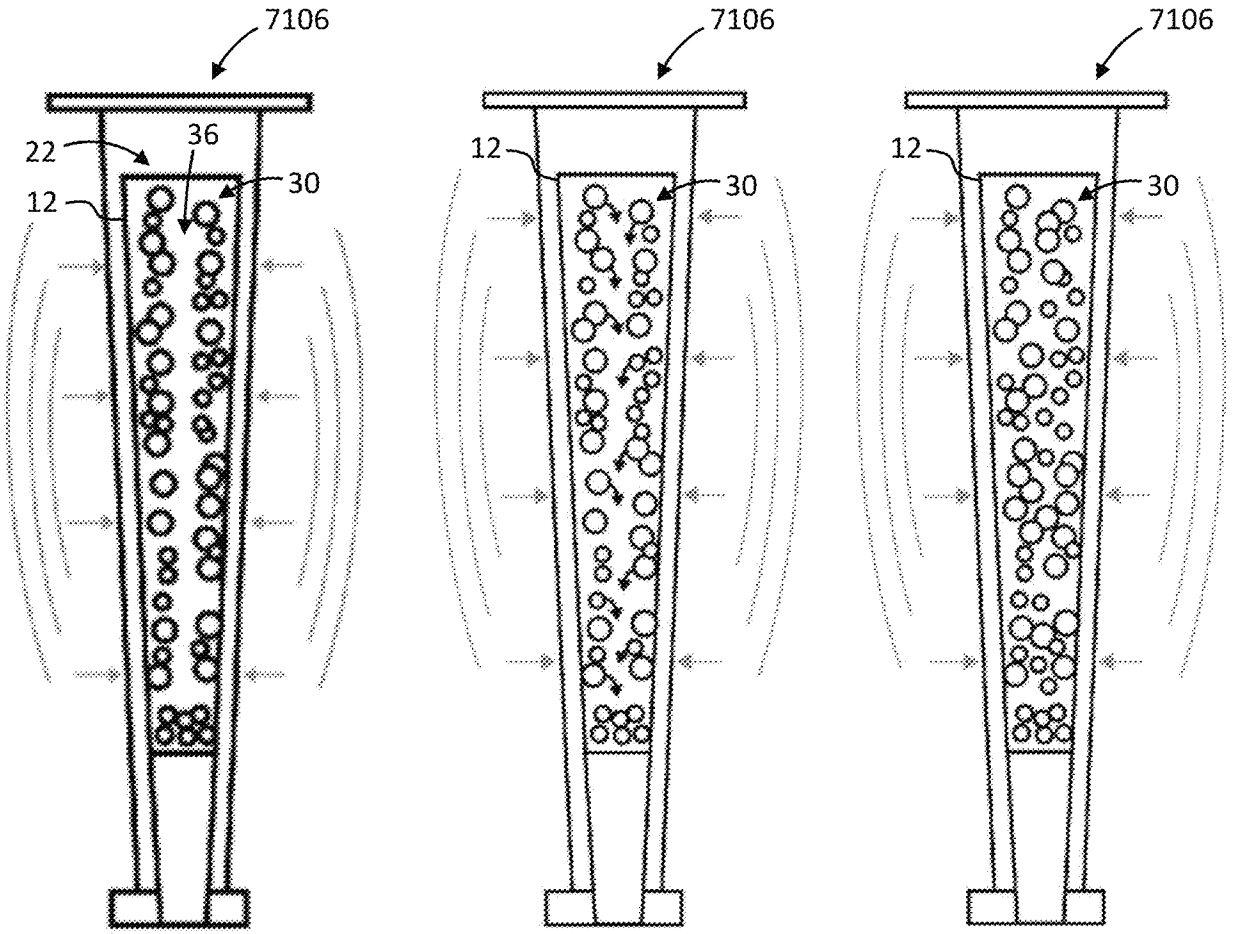
FIG. 32 is a schematic showing an empty column formed and collapsed in a volume of smokeable product held in an example cone.

Referring to FIG. 32, each cavity 7106 holds a respective cone 12. Each cone 12 is filled with a volume of smokeable product 30 and has an open upper end 22. Referring to FIG. 27A, in the example illustrated, the apparatus 7100 includes a compaction mechanism 7118 supported by the frame 7102. In the example illustrated, the compaction mechanism 7118 includes at least one pin 7122 extending along a pin axis and alignable with the open upper end of a respective cone 12 (and pallet cavity 7106). When aligned, the pin 7122 is movable vertically relative to the cone pallet 7104 between a pin retracted position (shown in FIG. 28) and a pin advanced position (shown in FIG. 29). When in the pin retracted position, the pin 7122 is spaced apart from the smokeable product 30 in the cone 12. When in the pin advanced position, a lower portion of the pin 7122 is inserted into the volume of the smokeable product 30 in the respective cone 12.

Referring to FIG. 27A, in the example illustrated, the compaction mechanism 7118 includes a plurality of the pins 7122 held by a pin carrier 7128. In the example illustrated, the quantity of pins 7122 is equal to the quantity of pallet cavities 7106, and the pins 7122 are simultaneously alignable with respective cavities 7106 and simultaneously translatable relative to the cone pallet 7104 between the pin retracted and advanced positions. In the example illustrated, the compaction mechanism 7118 further includes at least one pin vibratory drive 7130 coupled to the pins 7122 for vibrating the pins at least when the pins 7122 are in the pin advanced position to induce settlement of the smokeable product 30. In the example illustrated, the pin vibratory drive 7130 is coupled to the pin carrier 7128 for vibrating the pins 7122 through vibration of the pin carrier 7128.

In some examples, when advanced and withdrawn from the volume of the smokeable product 30, the pin 7122 can form an empty column 36 (FIG. 32) in the volume of the smokeable product 30. In the example illustrated, the compaction mechanism includes a pallet vibratory drive 7144 coupled to the cone pallet 7104 when the cone pallet 7104 is received in the frame 7102 for vibrating the cone pallet 7104 to induce collapse of the smokeable product 30 into the column 36. In the example illustrated, the pallet vibratory drive 7144 is operable to impart horizontal vibrations to the cone pallet 7104 when the cone pallet 7104 is received in the frame 7102. In the example illustrated, a platform 7146 is supported by the frame 7102, and the cone pallet is supported on the platform 7146 when received in the frame 7102. In the example illustrated, the pallet vibratory drive 7144 is coupled to the platform 7146 for vibrating the cone pallet 7104 through vibration of the platform 7146.

Figure 30:
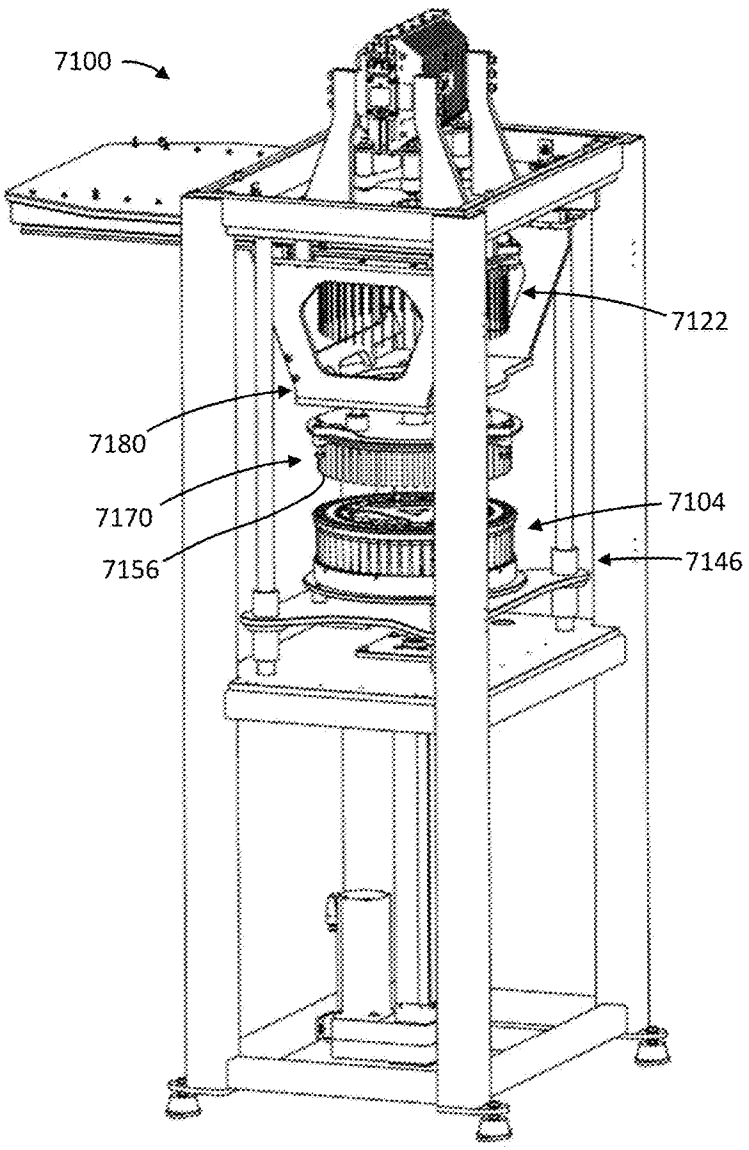
FIG. 30 is a perspective view like that of FIG. 28, but showing the carriage in an advanced configuration.

In the example illustrated, the compaction mechanism 7118 further includes at least one tamping rod 7170 separate from the pin 7122 and having a tamping face 7156 alignable with the open upper end 22 of the respective cone 12 (and pallet cavity 7106). Referring to FIG. 30, when aligned, the tamping face 7156 is movable relative to the cone pallet 7104 between a tamping retracted position (shown in FIG. 30) and a tamping advanced position (shown in FIG. 31). When in the tamping retracted position, the tamping face 7156 is spaced apart from the smokeable product 30 in the cone 12. When in the tamping advanced position, the tamping face 7156 is urged downwardly against an upper surface of the volume of the smokeable product 30 to exert a compressive force thereon. In the example illustrated, the pin 7122 includes a pin tip having a pin tip diameter, and the tamping face has a tamping face diameter that is greater than the pin tip diameter.

Referring to FIG. 27A, in the example illustrated, the compaction mechanism 7118 includes a plurality of the tamping rods 7170 held by a tamper carrier 7160. In the example illustrated, the quantity of tamping rods 7170 is equal to the quantity of pallet cavities 7106 (and pins 7122). In the example illustrated, the tamping faces 7156 are simultaneously alignable with respective cavities 7106 and simultaneously translatable relative to the cone pallet 7104 between the tamping face retracted and advanced positions. In the example illustrated, the compaction mechanism 7118 further includes at least one tamping vibratory drive 7146 coupled to the tamping rods 7170 for vibrating the tamping rods 7170 at least when the tamping faces 7156 are in the tamping advanced position. In the example illustrated, the tamping vibratory drive 7146 is coupled to the tamper carrier 7160 for vibrating the tamping rods 7170 through vibration of the tamper carrier 7160.

Referring to FIG. 26, in the example illustrated, the compaction mechanism 7118 includes a carriage 7180 movably supported by the frame 7102, and one of the pins 7122 and the tamping rods 7170 are mounted to the carriage 7180. In the example illustrated, the other one of the pins 7122 and tamping rods 7170 is generally fixed relative to the frame 7102 above the cone pallet 7104 (when received in the frame 7102), and in alignment with the open upper end 22 of respective cones 12 (and respective pallet cavities 7106). In the example illustrated, the tamper carrier 7160 holding the tamping rods 7170 is mounted to the carriage 7180, and the pin carrier 7128 holding the pins 7122 is generally fixed relative to the frame 7102 above the cone pallet 7104.

Figure 28:
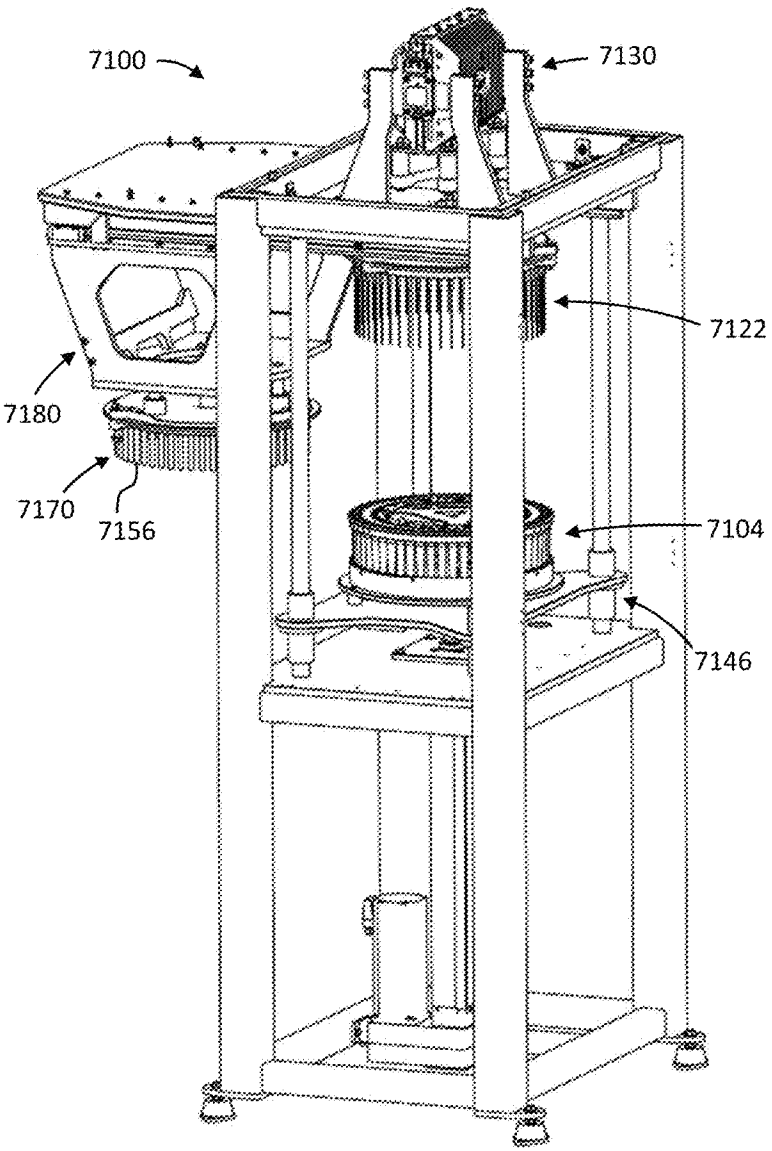
FIG. 28 is a perspective view of the compaction apparatus of FIG. 26.

In the example illustrated, the carriage 7180 is movable between a carriage retracted position (shown in FIG. 28) and a carriage advanced position (shown in FIG. 30). Referring to FIG. 28, when the carriage 7180 is in the carriage retracted position, the carriage 7180 and the tamping rods 7170 are horizontally clear of the cone pallet 7104 (and the pins 7122), and the pins 7122 are movable relative to the cone pallet 7104 toward the pin advanced position. Referring to FIG. 30, when the carriage 7180 is in the carriage advanced position, the tamping faces 7156 are in alignment with the open upper end of respective cones 12 (and the cavities 7106) and movable relative to the cone pallet 7104 toward the tamping advanced position (shown in FIG. 31). In the example illustrated, the tamping rods 7170 are in alignment with the pins 7122 when the carriage 7180 is in the carriage advanced position, and the tamping rods 7170 are vertically intermediate the pins 7122 and the cone pallet 7104 when the carriage 7180 is in the carriage advanced position and the tamping faces 7156 are in the tamping retracted position.

In the example illustrated, one or more actuators are supported by the frame 7102 for moving the pins 7122 between the pin advanced and pin retracted positions and for moving the tamping faces 7156 between the tamping advanced and tamping retracted positions. Referring to FIG. 26, in the example illustrated, the one or more actuators include a pallet actuator 7182 for vertically translating the cone pallet 7104 relative to the pins 7122 and tamping faces 7156. In the example illustrated, the pallet actuator 7182 comprises the platform 7146, and the platform 7146 is vertically translatable relative to the frame 7102 for translating the cone pallet 7104 (when supported on the platform 7146) among a lowered position (shown in FIGS. 28 and 30), a first raised position (shown in FIG. 31) above the lowered position, and a second raised position (shown in FIG. 29) above the first raised position. In the example illustrated, the lowered position corresponds to the pin retracted position and the tamping retracted position, and the cone pallet 7104 is at an elevation below the pins 7122 and tamping faces 7156 when in the lowered position.

Figure 29:
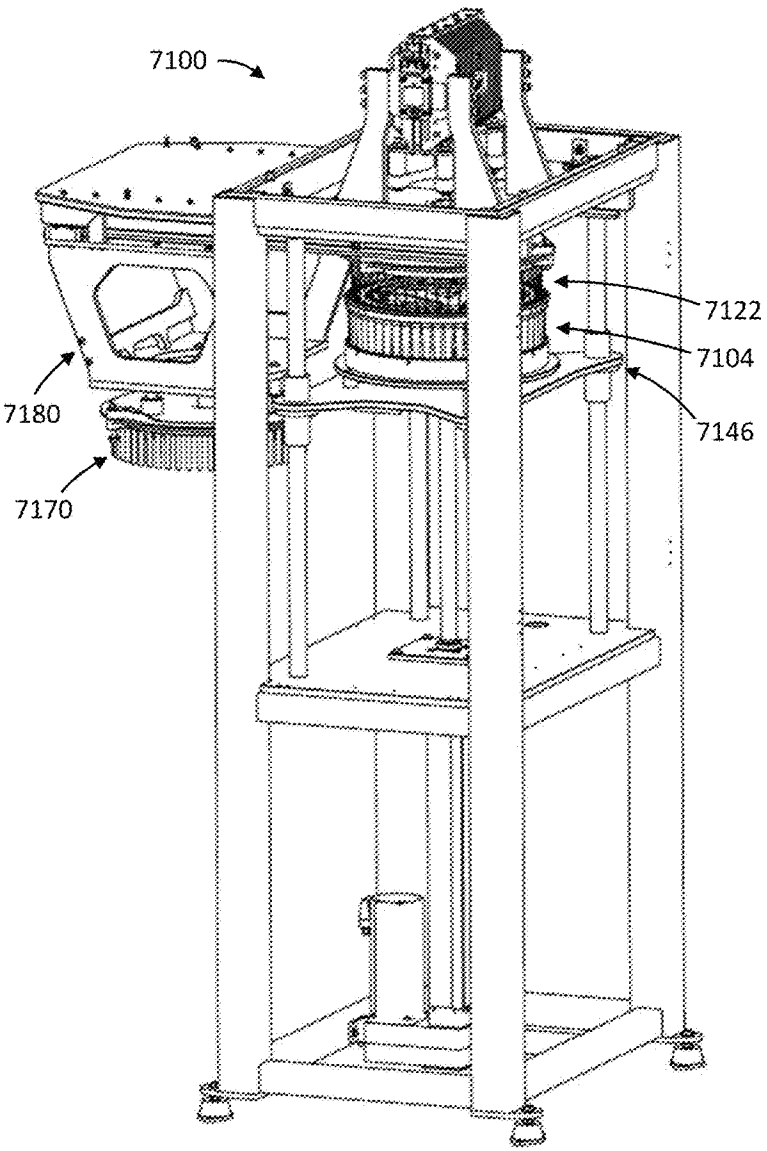
FIG. 29 is a perspective view like that of FIG. 28, but showing the pallet portion in a raised configuration.
Figure 31:
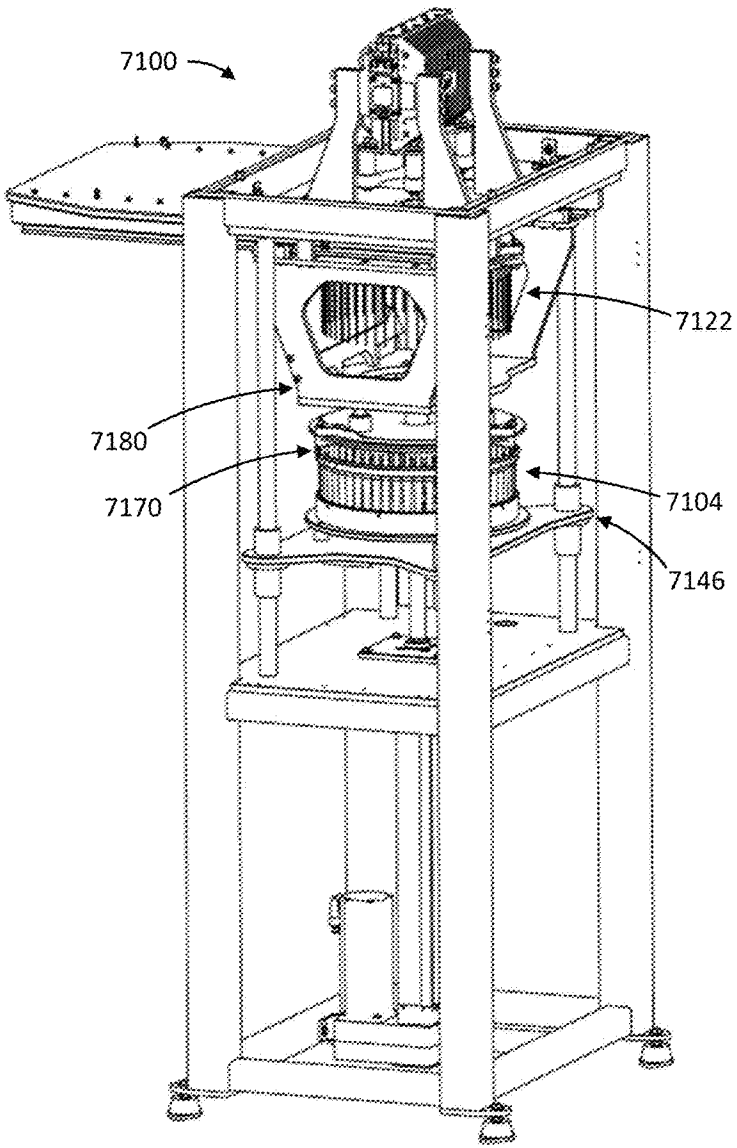
FIG. 31 is a perspective view like that of FIG. 28, but showing the carriage in the advanced configuration and the pallet portion in another raised configuration.

Referring to FIGS. 28 and 29, in the example illustrated, when the carriage 7180 is in the carriage retracted position, the pallet actuator 7182 is operable to raise the cone pallet 7104 from the lowered position toward the second raised position (and toward the pins 7122), to move the pins 7122 toward the pin advanced position. Referring to FIGS. 30 and 31, in the example illustrated, when the carriage 7180 is in the carriage advanced position, the pallet actuator 7182 is operable to raise the cone pallet 7104 from the pallet lowered position toward the first raised position (and toward the tamping faces 7156) to move the tamping faces 7156 toward the tamping advanced position. Referring to FIG. 26, in the example illustrated, the pallet actuator 7182 comprises a linear actuator 7200 coupled to the platform 7146 and powered by a drive 7202 for driving vertical translation of the platform 7146 (and the cone pallet 7104 among the lowered, first raised, and second raised positions). In the example illustrated, a plurality of vertical actuator guides 7186 are fixed relative to the frame 7102 for guiding vertical movement of the platform 7146 (and the cone pallet 7104 when supported on the platform 7146). In the example illustrated, the guides 7186 comprise vertical shafts.

Referring to FIG. 27A, in the example illustrated, a carriage actuator 7204 is supported by the frame 7102 for translating the carriage 7180 between the carriage retracted position and the carriage advanced position. In the example illustrated, the carriage actuator 7204 includes a linear actuator coupled to the carriage 7180 and powered by a drive for driving horizontal translation of the carriage between the carriage retracted position and the carriage advanced position.

Referring to FIG. 26, in the example illustrated, at least one horizontal carriage guide 7208 is supported by the frame 7102 for guiding horizontal movement of the carriage 7180 between the carriage retracted and advanced positions. In the example illustrated, the carriage guide 7208 includes at least one horizontal carriage rail 7210 supported by the frame 7102, and the carriage 7180 is slidably mounted on the at least one carriage rail 7210 for translation along the rail 7210 between the carriage retracted position and the carriage advanced position. In the example illustrated, the carriage guide 7208 (and carriage rail 7210) is at an elevation above the pin tips of the pins 7122 (and above the cone pallet 7104 and cavities 7106) when the pins 7122 are in the pin advanced position (and the cone pallet 7104 is in the second raised position). In the example illustrated, the carriage guide 7208 (and carriage rail 7210) is above the tamping faces 7156 (and above the cone pallet 7104 and cavities 7106) when the tamping faces 7156 are in the tamping advanced position (and the cone pallet 7104 is in the first raised position).

Referring to FIG. 27A, in the example illustrated, the at least one carriage rail 7210 comprises a pair of first and second rails 7210*a*, 7210*b* extending parallel with and spaced laterally apart from each other, and the pin carrier 7128 (and pins 7122) is laterally intermediate the first and second rails 7210*a*, 7210*b*. In the example illustrated, the carriage 7180 comprises a carriage frame 7212 holding the tamper carrier 7160 (and tamping rods 7170) at an elevation below the pins 7122. The carriage frame 7212 has a first side portion 7212*a* extending vertically between an upper end supported by the first rail 7210*a* and a lower end opposite the upper end, a second side portion 7212*b* extending vertically between an upper end supported by the second rail 7210*b* and a lower end opposite the upper end, and a bottom portion 7212*c* extending laterally between lower ends of the first and the second side portions 7212*a*, 7212*b* at an elevation below the pins 7122. In the example illustrated, the tamper carrier 7160 is mounted to and suspended from the bottom portion 7212*c*. The first and second side portions 7212*a*, 7212*b* are spaced horizontally apart 7210*a* by a carriage frame gap 7214. The carriage frame gap 7214 is sized for accommodating the pin carrier 7128 (and pins 7122) when the carriage 7180 is moved to the carriage advanced position.

Figure 33:
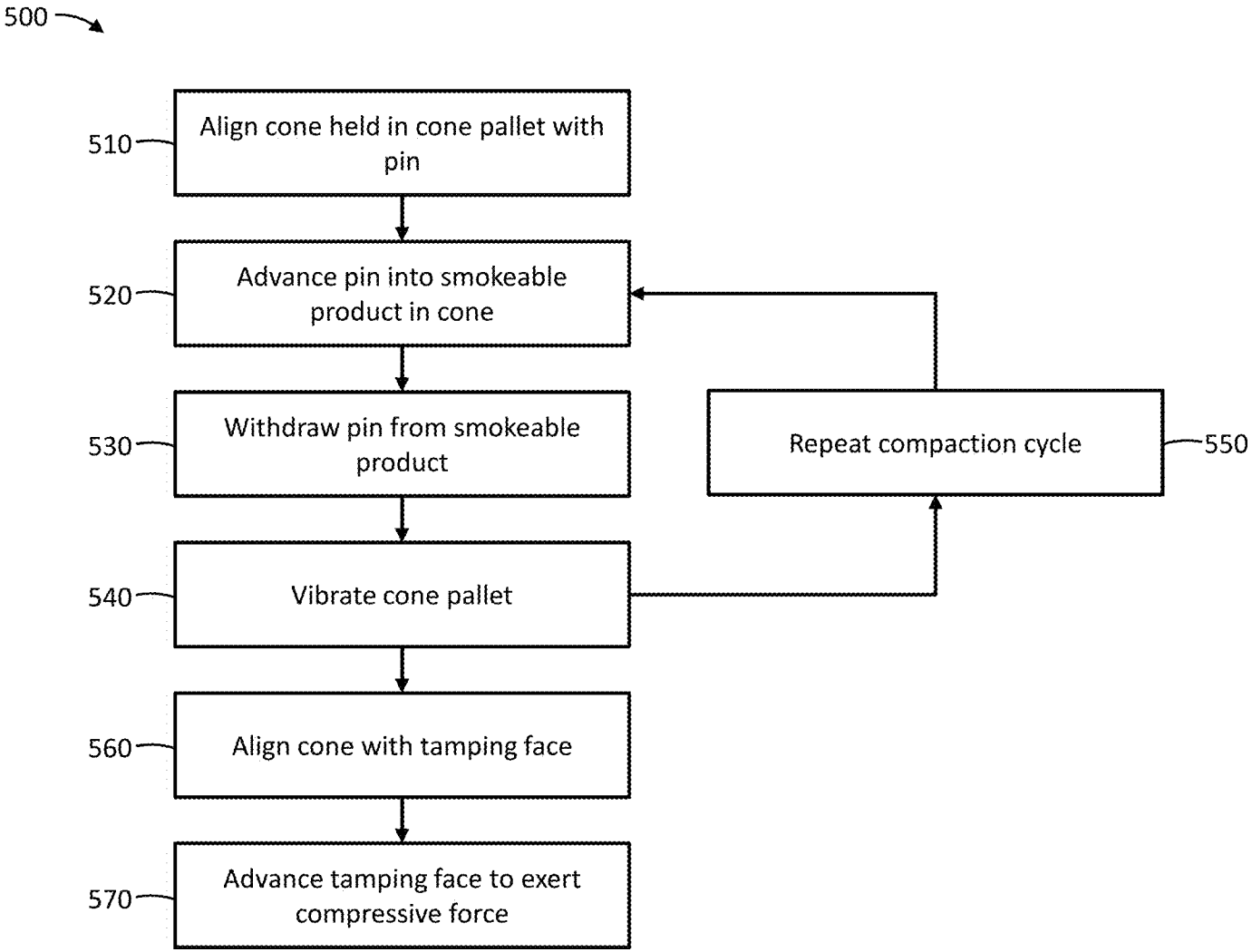
FIG. 33 is a flow chart showing another example process for mass production of conical smoking articles using a compaction apparatus like that disclosed in the present specification.
Figure 34:
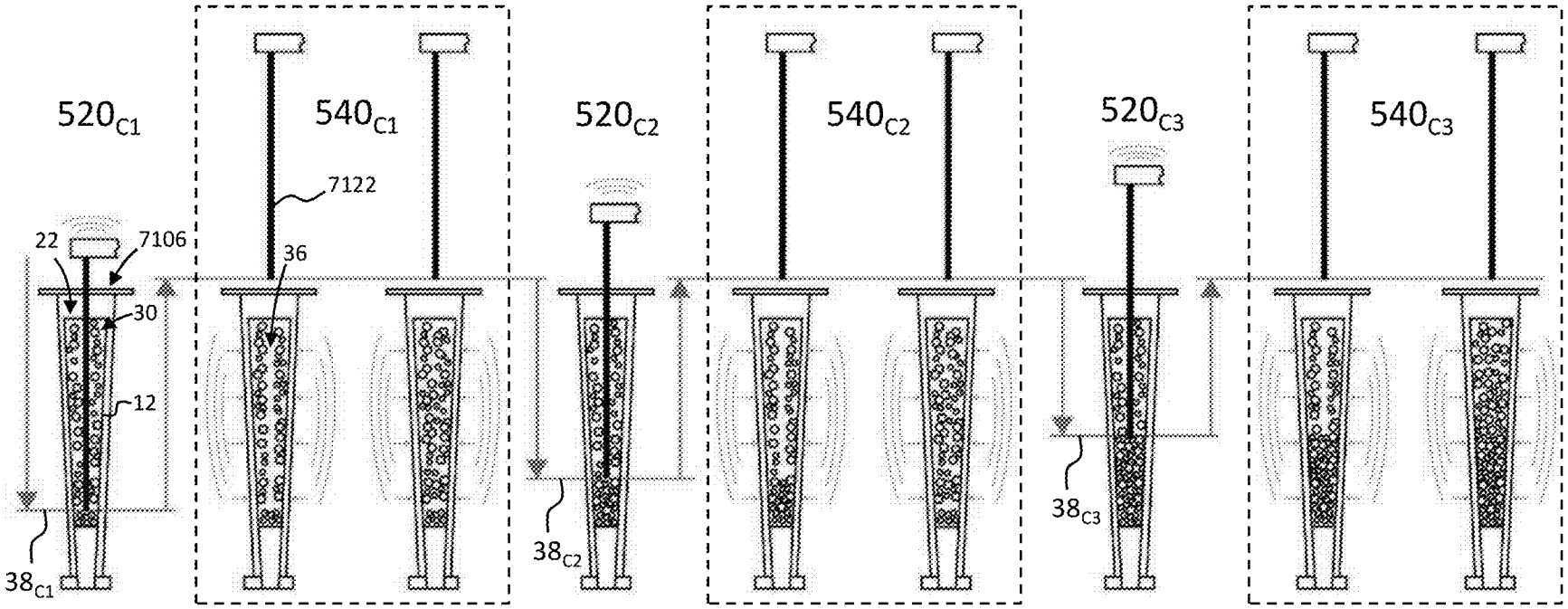
FIG. 34 is a schematic showing an example method of compacting smokeable product during a process like that of FIG. 33.

Referring to FIGS. 33 and 34, an example process 500 for mass production of smoking articles using a compaction apparatus similar to the compaction apparatuses of the present specification is shown, and will be described with respect to the compaction apparatus 7100. At 510 of the process 500, a cone 12 held in the cone pallet 7104 and holding a volume of the smokeable product 30 is aligned with a respective pin 7122. At 520, the pin 7122 is advanced into the volume of the smokeable product 30 through the open upper end 22 of the cone 12. At 530, the pin 7122 is withdrawn from the volume of the smokeable product 30, forming an empty column 36 in the volume of the smokeable product 30. At 540, the cone pallet 7104 is vibrated to induce collapse of the smokeable product 30 into the column 36. In the example illustrated, the cone pallet 7104 is vibrated horizontally to help induce collapse of the smokeable product 30 into the column 36. In the example illustrated, the pin 7122 is completely withdrawn from the volume of the smokeable product 30 prior to vibrating the cone pallet 7104.

In the example illustrated, at 550 of the process 500, steps 520 to 540 can be repeated to perform a plurality of successive compaction cycles (represented by subscripts C1-C3 in the example shown in FIG. 34). Referring to FIG. 34, in the example illustrated, during step 520, the pin 7122 is inserted into the cone 12 to an insertion depth 38, and the insertion depth 38 varies between two or more of the compaction cycles. The insertion depth 38 can be less during step 520 of a subsequent compaction cycle relative to the insertion depth 38 of an immediately preceding compaction cycle. In the example of FIG. 34, the insertion depth 38 of each subsequent compaction cycle is less relative to the insertion depth 38 of an immediately preceding compaction cycle (i.e. the insertion depth $\mathbf{38}_{C3}$ for cycle C3 is less than the insertion depth $\mathbf{38}_{C2}$ for cycle C2, and the insertion depth $\mathbf{38}_{C2}$ is less than the initial insertion depth $\mathbf{38}_{C1}$ for cycle C1).

In some examples, the process 500 can include the step of vibrating the pin 7122 when the pin is in the smokeable product 30 to induce settlement of the smokeable product 30 in the cone 12. The pin 7122 can be vibrated while being advanced through the smokeable product 30, while being withdrawn from the smokeable product 30, and/or while in the pin advanced position in the smokeable product 30. In some examples, the process 500 can include reciprocating the pin 7122 along a vertical axis in the volume of the smokeable product 30 during a compaction cycle to facilitate compaction of the smokeable product 30.

Referring to FIG. 33, in the example illustrated, after a sufficient number of compaction cycles are performed to achieve a desired density of the smokeable product 30, the process 500 can proceed to step 560. At 560, the cone 12 is aligned with a respective tamping face 7156. At 570, the tamping face 7156 is urged downwardly against an upper surface of the smokeable product 30 to exert a compressive force thereon. In some examples, the process 500 can include the step of vibrating the tamping face 7156 at least when the tamping face 7156 is being urged downwardly to exert the compressive force.

After the smokeable product 30 in each cone 12 is compacted, the pallet 7104 can be moved from the compaction apparatus 7100, and another pallet 7104 holding filled cones 12 with loose smokeable product can be received in the compaction apparatus 7100 for compaction of smokeable product. After the smokeable product in a pallet 7104 is compacted, the pallet 7104 can be moved to a cone closure station to facilitate the closing step 70 of the process 50

(FIG. 3). At the cone closure station, an upper portion of each cone 12 is twisted to close the open upper end 22 of each cone 12.

The invention claimed is:

1. A method of compacting a smokeable product in a cone for production of smoking articles, the method comprising:

a) aligning a respective cone held in a cone pallet with a pin, the cone containing a volume of the smokeable product and having an open upper end;

b) advancing the pin into the volume of the smokeable product through the open upper end of the cone;

c) withdrawing the pin from the volume of the smokeable product, the volume of the smokeable product having an empty column formed therein when the pin is withdrawn; and d) vibrating the cone pallet to induce collapse of the smokeable product into the column.

2. The method of claim 1, wherein the pin is completely withdrawn from the volume of the smokeable product prior to performing (d).

3. The method of claim 1, wherein (d) includes vibrating the cone pallet horizontally.

4. The method of claim 1, further comprising: (e) repeating (b) to (d) to perform a plurality of successive compaction cycles.

5. The method of claim 4, wherein (b) includes inserting the pin into the cone to an insertion depth, wherein the insertion depth varies between two or more of the compaction cycles.

6. The method of claim 5, wherein the insertion depth is less for each subsequent compaction cycle relative to an immediately preceding compaction cycle.

7. The method of claim 1, further comprising, when the pin is in the volume of the smokeable product, vibrating the pin to induce settlement of the smokeable product in the cone.

8. The method of claim 1, further comprising urging a tamping face downwardly against an upper surface of the smokeable product to exert a compressive force thereon.

9. The method of claim 8, wherein the tamping face is urged downwardly after (d).

10. The method of claim 8, further comprising vibrating the tamping face at least when the tamping face is urged downwardly.

11. A compaction apparatus for compacting a smokeable product in production of smoking articles, comprising:

a) a frame for removably receiving a cone pallet, the cone pallet including a plurality of cavities, each cavity holding a respective cone filled with a volume of the smokeable product, each cone having an open upper end;

b) a compaction mechanism supported by the frame, the compaction mechanism including:

(i) at least one pin extending along a pin axis and alignable above the open upper end of a respective cone, and when aligned, the pin movable relative to the cone pallet from a pin retracted position, in which the pin is spaced apart from the smokeable product in the cone, toward a pin advanced position in which a lower portion of the pin is inserted into the volume of the smokeable product in the respective cone, the pin forming an empty column in the volume of the smokeable product when withdrawn; and (ii) a pallet vibratory drive coupled to the cone pallet when the pallet is received in the frame for vibrating the cone pallet to induce collapse of the smokeable product into the column.

12. The compaction apparatus of claim 11, wherein the pallet vibratory drive is operable to impart horizontal vibrations to the cone pallet when the cone pallet is received in the frame.

13. The compaction apparatus of claim 11, further comprising a platform supported by the frame, the platform for supporting the cone pallet when the cone pallet is received in the frame, and the pallet vibratory drive coupled to the platform for imparting vibrations thereto.

14. The compaction apparatus of claim 11, wherein the compaction mechanism comprises a pin vibratory drive coupled to the pin, the pin vibratory drive operable to vibrate the pin at least when the pin is in the pin advanced position to induce settlement of the smokeable product in the respective cone.

15. A compaction apparatus for compacting a smokeable product in production of smoking articles, comprising:

a) a frame for removably receiving a cone pallet, the cone pallet including a plurality of cavities, each cavity holding a respective cone filled with a volume of the smokeable product, each cone having an open upper end;

b) a compaction mechanism supported by the frame, the compaction mechanism including:

i. at least one pin extending along a pin axis and alignable above the open upper end of a respective cone, and when aligned, the pin is movable relative to the cone pallet from a pin retracted position, in which the pin is spaced apart from the smokeable product in the cone, toward a pin advanced position in which a lower portion of the pin is inserted into the volume of the smokeable product in the respective cone; and ii. at least one tamping rod separate from the pin and having a tamping face alignable above the open upper end of the respective cone, and when aligned, the tamping face is moveable relative to the cone pallet from a tamping retracted position in which the tamping face is spaced apart from the smokeable product in the cone, toward a tamping advanced position in which the tamping face is urged downwardly against an upper surface of the volume of smokeable product to exert a compressive force thereon.

16. The compaction apparatus of claim 15, wherein the compaction mechanism includes a carriage movably supported by the frame, and one of the at least one pin and the at least one tamping rod is mounted to the carriage.

17. The compaction apparatus of claim 16, wherein the carriage is movable between a carriage retracted position and a carriage advanced position, wherein when the carriage is in the carriage retracted position, the one of the at least one pin and the at least one tamping rod is horizontally clear of the cone pallet when the cone pallet is received in the frame, and when the carriage is in the carriage advanced position, the one of the at least one pin and the at least one tamping rod is alignable with the respective cavity of the cone pallet when the cone pallet is received in the frame.

18. The compaction apparatus of claim 17, wherein the other one of the at least one pin and the at least one tamping rod is generally fixed relative to the frame and is above the cone pallet when the cone pallet is received in the frame.

19. The compaction apparatus of claim 17, wherein when the carriage is in the carriage advanced position, the one of the at least one pin and the at least one tamping rod is below and in alignment with the other one of the at least one pin and the at least one tamping rod.

20. The compaction apparatus of claim 17, wherein the compaction mechanism includes at least one horizontal carriage rail supported by the frame, and wherein the carriage is slidably mounted on the rail for translation along the rail between the carriage retracted position and the carriage advanced position.

21. The compaction apparatus of claim 20, wherein the rail is at an elevation above the one of the at least one pin and the at least one tamping rod when the carriage is in the carriage advanced position.

22. The compaction apparatus of claim 20, wherein the rail is at an elevation above a tip of the at least one pin when the at least one pin is in the pin advanced position, and above the tamping face when the tamping face is in the tamping advanced position.

23. The compaction apparatus of claim 20, further comprising a pallet actuator supported by the frame and including a vertically translatable platform, the platform for supporting the cone pallet when the cone pallet is received in the frame, and the platform vertically translatable relative to the frame for translating the cone pallet among a lowered position, a first raised position above the lowered position, and a second raised position above the first raised position, the lowered position corresponding to the pin retracted position and the tamping retracted position, the first raised position corresponding to one of the pin advanced position and the tamping advanced position, and the second raised position corresponding to the other one of the pin advanced position and the tamping advanced position.

24. The compaction apparatus of claim 23, wherein the rail is at an elevation above the cone pallet when the cone pallet is in the second raised position.

25. The compaction apparatus of claim 15, wherein the compaction mechanism comprises a pin vibratory drive coupled to the pin for vibrating the pin at least when the pin is in the pin advanced position.

26. The compaction apparatus of claim 15, wherein the compaction mechanism includes at least one tamping vibratory drive coupled to the tamping rod for vibrating the tamping face at least when the tamping face is in the tamping advanced position.

27. The compaction apparatus of claim 15, wherein the compaction mechanism includes a pallet vibratory drive coupled to the cone pallet when the cone pallet is received in the frame for vibrating the cone pallet.

28. The compaction apparatus of claim 15, wherein the pin tip has a pin tip diameter, and the tamping face has a tamping face diameter greater than the pin tip diameter.

* * * * *